US012703984B2

(12) United States Patent
Claerhout

(10) Patent No.: US 12,703,984 B2
(45) Date of Patent: Aug. 11, 2026

(54) PANEL FOR FORMING A COVERING

(71) Applicant: UNILIN, BV, Wielsbeke (BE)

(72) Inventor: Matthias Claerhout, Wielsbeke (BE)

(73) Assignee: UNILIN, BV, Wielsbeke (BE)

( * ) Notice: Subject to any disclaimer, the term of this patent is extended or adjusted under 35 U.S.C. 154(b) by 114 days.

(21) Appl. No.: 18/823,267

(22) Filed: Sep. 3, 2024

(65) Prior Publication Data

US 2025/0084649 A1 Mar. 13, 2025

(30) Foreign Application Priority Data

Sep. 7, 2023 (BE) ..... 2023/5735

(51) Int. Cl.
*E04F 15/02* (2006.01)
*E04F 13/08* (2006.01)

(52) U.S. Cl.
CPC .... *E04F 15/02038* (2013.01); *E04F 13/0894* (2013.01); *E04F 2201/0146* (2013.01); *E04F 2201/0161* (2013.01); *E04F 2201/023* (2013.01); *E04F 2201/042* (2013.01); *E04F 2201/043* (2013.01); *E04F 2201/044* (2013.01)

(58) Field of Classification Search
CPC ..... E04F 13/0894; E04F 15/04; E04F 15/10; E04F 2201/0138; E04F 2201/0146; E04F 2201/0153; E04F 2201/0161; E04F 2201/023; E04F 2201/042; E04F 2201/043; E04F 2201/044; E04F 2201/0535
USPC ..... 52/588.1
See application file for complete search history.

(56) References Cited

U.S. PATENT DOCUMENTS 745,000 A * 11/1903 Coffield ..... E04F 15/02 52/506.01
2,430,200 A * 11/1947 Wilson ..... E04F 15/04 52/538
3,205,633 A * 9/1965 Nusbaum ..... E04F 15/10 52/591.1
3,687,773 A * 8/1972 Wangborg ..... B27B 1/00 52/390
5,950,388 A * 9/1999 Jaklin ..... A63C 19/12 52/592.1
6,216,410 B1 * 4/2001 Haberman ..... E04F 13/12 52/592.1
6,505,452 B1 1/2003 Hannig et al.
(Continued)

FOREIGN PATENT DOCUMENTS

WO 0102669 A1 1/2001
WO 0175247 A1 10/2001
(Continued)

OTHER PUBLICATIONS

Belgian Search Report from Corresponding Belgian Patent Application No. BE2023/5735, Oct. 1, 2024.

*Primary Examiner* — Brian D Mattei
*Assistant Examiner* — Joseph J. Sadlon
(74) *Attorney, Agent, or Firm* — Workman Nydegger

(57) ABSTRACT

A panel for forming a covering, includes a first pair of opposite edges and a second pair of opposite edges. The first pair of opposite edges defines a first edge and a second edge of the panel. The second pair of opposite edges defines a third edge and a fourth edge of the panel. The first pair of opposite edges has coupling parts which make it possible for two such panels to be coupled to each other.

20 Claims, 6 Drawing Sheets

(56) References Cited

U.S. PATENT DOCUMENTS 6,793,586 B2 * 9/2004 Barlow ..... A63B 57/40 473/162
7,454,875 B2 * 11/2008 Pervan ..... E04F 15/02038 52/586.2
8,281,549 B2 * 10/2012 Du ..... E04F 15/02038 52/591.1
8,302,361 B2 * 11/2012 Braun ..... F16B 5/0076 52/390
8,544,232 B2 * 10/2013 Wybo ..... B29C 66/12423 52/588.1
8,584,432 B2 * 11/2013 Braun ..... F16B 5/0056 52/390
8,752,353 B2 * 6/2014 Zinser ..... E04C 2/46 52/561
8,844,225 B2 * 9/2014 Harris ..... E01C 5/005 52/302.1
8,869,485 B2 * 10/2014 Pervan ..... E04B 1/38 52/592.1
9,151,060 B2 * 10/2015 Khongbantabam ..... E04F 13/0894
9,206,611 B2 * 12/2015 Vermeulen ..... E04B 5/023
9,781,997 B2 * 10/2017 Maertens ..... F16B 5/0012
10,214,914 B2 * 2/2019 Bachelder ..... E04F 15/02038
10,858,846 B2 * 12/2020 Loebel ..... E04B 1/6125
11,840,847 B2 * 12/2023 Perrine ..... E04F 15/02038
12,326,002 B2 * 6/2025 Boucké ..... C08L 75/04
2013/0180193 A1 * 7/2013 Bossuyt ..... E04F 15/02 52/309.1
2014/0215946 A1 * 8/2014 Roy ..... E04F 15/02 52/309.1
2018/0355619 A1 * 12/2018 Neuman ..... E04F 15/102
2024/0376722 A1 * 11/2024 Lobbens ..... E04F 15/02038

FOREIGN PATENT DOCUMENTS

WO 2009066153 A2 5/2009
WO 2010100046 A1 9/2010
WO 2011001326 A2 1/2011
WO 2017068523 A1 4/2017
WO 2020161627 A1 8/2020
WO 2021111210 A1 6/2021

* cited by examiner

PANEL FOR FORMING A COVERING

BACKGROUND

The present invention relates to panels for forming a covering, more particularly floor panels for forming a floor covering or wall panels for forming a wall covering. The present invention also relates to a method for forming such panels.

More particularly, the invention relates to panels which can be coupled to each other by means of mechanical coupling parts. In this case, the term panels is to be understood to refer to both flexible and non-flexible panels, as well as panels with little flexibility.

It is the object of the invention to enable easy installation of a covering composed of such panels and without damage or a limited risk of damage during installation, while simultaneously still rendering the covering sufficiently strong, more particularly making it possible to produce sufficiently strong connections between the panels. In addition, it is also desirable for the panels to be such that they can be produced at relatively low cost.

First and foremost, the invention is aimed at panels which can be installed by means of the so-called fold-down technique, so as to satisfy the intended requirement of ease of installation.

The term "fold-down technique" is understood to refer to a technique as described, inter alia, in patent documents WO 01/75247, WO 01/02669, WO 2020/161627 and WO 2021/111210 in which the coupling parts on a pair of opposite edges are thus configured in such a way that two such panels can be coupled to each other along these edges by means of a rotating movement, while at the same time, due to the downward folding movement on the other pair of opposite edges, a coupling is automatically also brought about along these edges. In the case of elongate panels, the latter pair of edges is preferably formed by the short sides of the panel.

A fact here is that two of the edges, usually the short edges in the case of elongate panels, must be able to be joined together via a downward movement, in which case a vertical locking has to be brought about. Such a vertical locking can be produced by means of separate elastic locking strips. However, the production and installation of these is expensive. In order to exclude such costs, integral or substantially integral coupling profiles may be used. However, it is known that the currently known coupling profiles which are formed as a single part with the material of the panels sometimes result in a connection which lacks strength; either the connection is too stiff and the panels cannot be joined or can only be joined by damaging them, or the coupling does not offer sufficient resistance to unlocking. The quality of the coupling depends on the configuration details and the materials used.

It was found that the ease of installation of the covering, such as for example the floor covering or wall covering, and the strength in the covering depends greatly on the characteristic features of the coupling parts, and in particular on the support surfaces and contact surfaces, as well as on the position and the form of the locking parts which provide vertical locking.

Various techniques have already been proposed in the prior art to provide user-friendly and reliable integral coupling parts along the edges of panels.

According to a known particular technique, use is made of vertically active locking parts which are formed as a single part with the material of the floor panel and which vary in shape, depending on the longitudinal direction of the edge on which they are provided. This technique is known per se from WO 2010/100046, according to which coupling parts are provided near the distal side of the distal end with a locking lug which vary in the longitudinal direction of the edge. This solution, as well as other known solutions, have various drawbacks and have been found not to be very efficient.

SUMMARY

The invention is generally aimed at providing an improved panel and more specifically at eliminating or minimizing one or more of the abovementioned drawbacks.

To this end, the invention, according to a first aspect, relates to a panel, for example a floor panel or a wall panel, for forming a covering, for example a floor covering or a wall covering,

- wherein this panel comprises a substrate and a top layer with a decorative surface, wherein the panel comprises a first pair of opposite edges and a second pair of opposite edges;
- wherein the first pair of opposite edges defines a first edge and a second edge of the panel, and the second pair of opposite edges defines a third edge and a fourth edge of the panel;
- wherein the first pair of opposite edges comprises coupling parts for coupling two such panels to each other, these coupling parts having the following characteristic features:
- the coupling parts preferably comprise a horizontally active locking system which, in a coupled state of two such panels, brings about a locking in the plane of the panels and at right angles to the respective edges;
- the coupling parts comprise a vertically active locking system which, in a coupled state of two such panels, brings about a locking at right angles to the plane of the panels;
- the coupling parts are configured in such a way that two such panels can be coupled to each other along these edges by means of a rotating movement;
- wherein the second pair of opposite edges comprises coupling parts for coupling two such panels to each other, these coupling parts having the following characteristic features:
- the coupling parts comprise a horizontally active locking system with horizontally active locking parts which, in a coupled state of two such panels, brings about a locking in the plane of the panels and at right angles to the respective edges;
- the coupling parts comprise a vertically active locking system with vertically active locking parts which, in a coupled state of two such panels, brings about a locking at right angles to the plane of the panels;
- the coupling parts are at least composed of an upwardly directed lower hook-shaped portion which is situated on the third edge, and a downwardly directed upper hook-shaped portion which is situated on the fourth edge, wherein the lower hook-shaped portion consists of a lip with an upwardly directed locking element which, proximally therefrom, defines a female part in the form of an upwardly directed recess, whereas the upper hook-shaped portion consists of a lip with a downwardly directed locking element which forms a male part and which, proximally therefrom, defines a downwardly directed recess, wherein the upwardly directed locking element is designed to extend at least partly in the downwardly directed recess and the downwardly directed locking element is designed to extend at least partly in the upwardly directed recess;

the coupling parts are configured in such a way that two such panels can be coupled to each other along their respective edges by means of a downward movement of the one panel with respect to the other panel;

the third edge comprises an upright first closing surface which extends substantially in the longitudinal direction of the third edge, and the fourth edge comprises an upright second closing surface which is complementary to the first closing surface and extends substantially in the longitudinal direction of the fourth edge, wherein, in the coupled state of two such panels, the first closing surface of the one panel (virtually) bears against the second closing surface of the other panel, both together thus forming an upright closing surface, this closing surface extending between the decorative surfaces and the vertically and horizontally active locking parts;

wherein the second closing surface extends upright from a lower point, wherein a plane which extends parallel to the decorative surface and through this lower point divides the downwardly directed locking element into an upper portion and a lower portion which adjoins this upper portion, so that the lower portion is delimited by a distal side and a proximal side, as well as by a bottom of the downwardly directed locking element, this lower portion being designed to extend at least partly in the upwardly directed recess;

characterized in that the panel has the following characteristic features on the second pair of opposite edges:

viewed along the longitudinal direction of the fourth edge, the lower portion of the downwardly directed locking element comprises a first section and a second section, wherein, viewed along a direction parallel to the decorative surface and at right angles to the fourth edge, the distal side of the first section extends beyond the distal side of the second section and beyond the second closing surface.

This means that the first section extends distally beyond the second section and also beyond the second closing surface. Therefore, the maximum distance between the distal side of the lower portion and the second closing surface is variable here along the longitudinal direction. Viewed along the longitudinal direction of the fourth edge, the cross section of the fourth edge varies. As a result of all this, this first section, during the downward movement of the one panel with respect to the other panel when coupling these panels to each other, creates a distance between the top layers and the decorative surfaces, so that these decorative surfaces, at least temporarily, extend a distance apart during coupling of two panels, limiting the risk of damage resulting from installation. Since there is also such a second section, a good yet easily achievable coupling is ensured, and the risk of undesired apertures between coupled panels is small.

Further characteristic features will become clear from the description and the attached claims.

Preferably, the lower portion, viewed along the longitudinal direction of the fourth edge, only comprises this first section, this second section and optionally a transition section between this first section and this second section. Such a panel can easily be produced by means of, for example, one or more milling tools which are displaceable in one direction away from and towards the edge to be milled, for example along a direction at right angles to the edge to be milled and parallel to the decorative surface.

The coupling parts of the second pair of opposite edges may be formed as a single part with the material of the panel itself. However, the coupling parts of the second pair of opposite edges may also comprise an additional locking strip.

Preferably, the vertically active locking parts are at least formed by a first locking part which is present on the aforementioned third edge and extends substantially in the longitudinal direction of the third edge, and a second locking part which is present on the aforementioned fourth edge and extends substantially in the longitudinal direction of the fourth edge, wherein, in the coupled state of two such panels, the first locking part of the one panel cooperates with the second locking part of the other panel; and wherein the first locking part and the second locking part are situated at levels which are higher than a bottom of the upwardly directed recess. Still more preferably, the vertically active locking parts comprise at least a third locking part which is present on the aforementioned third edge and extends substantially in the longitudinal direction of the third edge, and a fourth locking part which is present on the aforementioned fourth edge and extends substantially in the longitudinal direction of the fourth edge, wherein, in the coupled state of two such panels, the third locking part of the one panel cooperates with the fourth locking part of the other panel; and wherein the third locking part and the fourth locking part are preferably situated at levels which are higher than the bottom of the upwardly directed recess. In the coupled state, the first and the second locking part are preferably at a distance from the third and the fourth locking part, viewed along a direction parallel to the coupled panels and at right angles to the edges, so that a strong vertical locking is achieved. If the coupling parts of the second pair of opposite edges are formed as a single part, then the first locking part is preferably situated on the proximal side of the female part and is in this case present on this proximal side in a solid manner, and the second locking part is situated on the distal side of the male part and is in this case preferably also present on this distal side in a solid manner. In this definition, the expression "present in a solid manner" is to be understood as meaning that no weakened sections and/or recesses are provided behind the respective locking part, at least no weakened sections and/or recesses which are intended to allow certain deformations. More particularly, this is understood to mean that no weakened sections and/or recesses of the type as known from, inter alia, WO2011/001326 are used.

In a highly preferred embodiment, the coupling parts of the first pair of opposite edges are at least formed by a tongue which is situated on the first edge and a groove which is situated on the second edge, wherein the fourth edge, viewed along the longitudinal direction of the fourth edge from the first edge towards the second edge, comprises a first half and a second half which adjoins the first half, wherein the first section extends at least at the location of the first half and/or wherein the first section extends between the first edge and the second section. Here, the first section is situated closer to the first edge and/or starts from the first edge. The first edge comprises the tongue and this is usually the edge which is rotated during installation in said groove of another panel. Here, the first section is then very well capable of keeping the decorative surfaces at a distance apart during installation.

It will be clear that the term coupling parts is understood as referring to profiling which is the result of a specific modification. Normally, edge variations which result from profiling converging at corners of panels do not contribute to the coupling.

Preferably, the first section always extends beyond the second closing surface, so that the first section extends beyond the second closing surface, viewed along its entire length.

Preferably, viewed along the longitudinal direction of the fourth edge, the length of the first section is at least 20% of the total length of the fourth edge, preferably at least 30% and most preferably at least 40%. Also preferably, viewed along the longitudinal direction of the fourth edge, the length of the first section is at most 80% of the total length of the fourth edge, preferably at most 70% and most preferably at most 60%. At this point, there is a good balance between keeping the decorative surfaces a sufficient distance apart during coupling of two panels, while ensuring that the coupling can be brought about sufficiently easily and the coupling produced is sufficiently strong. In a specific embodiment, the length of the first section is between 40% and 50% of the total length of the fourth edge and the total length of the second section is between 40% and 50% of the total length of the fourth edge. If a said transition section is present between the first and the second section, then the length of this transition section is preferably between 0% and 20% of the total length of the fourth edge, more preferably between 5% and 15%. The panels are rectangular, square or elongate, with the first pair of opposite edges preferably forming the long edges and the second pair of opposite edges forming the short edges, in which case the total length of the fourth edge then corresponds to the size of the panel viewed along the width direction. The length of the fourth edge is then the width of the panel.

Preferably, viewed along a direction parallel to the decorative surface and at right angles to the fourth edge, the distal side of the second section extends beyond the second closing surface and/or at least partly at the location of the second closing surface. In this way, the second section also contributes to preventing damage to the decorative surfaces when coupling panels to each other by means of said downward movement. Both the first section and the second section, viewed along the distal direction, extend beyond a vertical plane through the second closing surface and at right angles to the plane of the panel, or the second section extends at least at the location of this vertical plane.

In a highly preferred embodiment, the first closing surface and the second closing surface extend virtually at right angles to the decorative surface and the closing surface extends virtually at right angles to the decorative surface.

Preferably, viewed along the longitudinal direction of the third edge, the design of the upwardly directed recess is constant. This means that the design of the upwardly directed recess does not vary. Still more preferably, the design of the third edge, and thus of the lower hook-shaped portion, is constant viewed along the longitudinal direction. The cross section of the third edge is then also identical everywhere, not taking any edge variations produced by the convergence of profiling at corners of panels into account. The profiling of the third edge can then also be carried out in a simple manner, for example by means of one or more milling tools which each rotate at one position. Furthermore preferably, the designs of the first and the second edge are constant, viewed along the longitudinal direction of the first and the second edge. In this case, only the design of the fourth edge is variable.

Viewed along the longitudinal direction of the fourth edge, the design of the upper portion of the downwardly directed locking element and/or the design of the downwardly directed recess is virtually constant. In this case, only the design of the lower portion is variable, viewed along the longitudinal direction of the fourth edge, so that the fourth edge can be produced in a fairly uncomplicated way.

In a preferred embodiment, the lower portion of the downwardly directed locking element of the fourth edge comprises a bottom portion at the bottom which is delimited at the bottom by the bottom of the downwardly directed locking element and is designed to extend in the upwardly directed recess of the third edge, with this bottom portion, at least at the location of the first section and preferably along the entire longitudinal direction, forming the most distal portion of the downwardly directed locking element, and at least a portion of the proximal side of the upwardly directed recess of the third edge extends proximally from and at a distance from the first closing surface, so that the bottom portion is accommodable in the upwardly directed recess. The design of the recess is such that the bottom portion of the first section fits therein, and since the bottom portion of the second section extends less far distally, the bottom portion is also accommodable in this recess. As the bottom portion, at least at the location of the first section and preferably along the entire longitudinal direction, forms the most distal portion of the downwardly directed locking element, the panels and thus also the decorative surfaces will be kept at a distance apart during coupling upon first contact during the downward movement while coupling the panels, as a result of which the risk of damage at the location of the decorative surfaces during the coupling is small.

In a specific embodiment, the vertically active locking parts comprise at least a first locking part which is present on the third edge and extends substantially in the longitudinal direction of the third edge, and a second locking part which is present on the fourth edge and extends substantially in the longitudinal direction of the fourth edge, wherein, in the coupled state of two such panels, the first locking part of the one panel cooperates with the second locking part of the other panel.

Furthermore preferably, the first locking part is situated on the proximal side of the female part and the second locking part is situated on the distal side of the bottom portion.

Still more preferably, the coupling parts of the second pair of opposite edges are formed as a single part with the material of the panel itself, and the first locking part is preferably present on the proximal side of the female part in a solid manner and the second locking part is preferably present on the distal side of the bottom portion in a solid manner. Such an embodiment is described in WO 2021/111210. The coupling parts described in these patent publications are deemed to be incorporated herein by reference, wherein obviously the fourth edge comprises said first and second section for the invention.

Also preferably, the second locking part forms part of the bottom portion, and preferably the first and the second locking part form cooperating locking faces, these locking faces extending virtually parallel to the decorative surfaces. In this case, the first and the second section can simply be formed by means of one or more milling tools, with at least one of these milling tools being displaceable away from the edge to be milled and towards the edge to be milled, preferably along a direction at right angles to the edge to be milled and parallel to the panel.

In another specific embodiment, the coupling parts of the second pair of opposite edges comprise at least a separate locking element, for example a locking strip, which, in a coupled state, cooperates with a locking groove of the coupling parts in order to partly or completely form the vertically active locking parts. The separate locking element may be accommodated in the third edge, in which case the locking groove then extends in the fourth edge. Such an embodiment is described in WO 2009/066153 and WO 2020/161627. The coupling parts described in these patent publications are deemed to be incorporated herein by reference, wherein obviously the fourth edge comprises said first and second section for the invention. The separate locking element may also be accommodated in the fourth edge, in which case the locking groove then extends in the third edge. Such an embodiment is described in WO 2017/068523. The coupling parts described in these patent publications are deemed to be incorporated herein by reference, wherein obviously the fourth edge comprises said first and second section for the invention.

Furthermore preferably, the separate locking element, at least in the coupled state, bears against the bottom portion.

Also furthermore preferably, one of the following characteristic features is present:

- the third edge comprises the separate locking element and the locking groove is present in the fourth edge, wherein the upper side of the bottom portion preferably delimits the underside of the locking groove and wherein, in the coupled state, the separate locking element is in contact with the upper side of the bottom portion, thus forming the first and the second locking part, respectively; or
- the fourth edge comprises the separate locking element and the locking groove is present in the third edge.

In a preferred embodiment, viewed along the longitudinal direction of the fourth edge, the design of the first section and the second section is constant, wherein the first section may directly adjoin the second section or wherein there is a transition section which (gradually) spans the distance between the first section and the second section, viewed along a direction parallel to the decorative surface and at right angles to the fourth edge. Due to the fact that the design of the first section is constant, the decorative surfaces are kept at a distance apart along the entire length of the first section when coupling panels to each other according to said downward movement. Said transition section makes it possible to produce the coupling parts in a simple manner by means of one or more milling tools and/or other cutting tools during the linear displacement of said fourth edge along said one or more tools. Thus, for example, one or more of said tools can be arranged in such a way that they are displaceable along a direction of movement at right angles to the direction of linear displacement of the panel and parallel to the panel in order to change the distance to the edge in which the fourth edge with coupling parts is formed. Thus, it is possible first to form the second section during the linear displacement of the panel and then, during the formation of the fourth edge, to move away from a said milling tool along the direction of movement up to a certain point, in which case the transition section is formed first, followed by the first section which extends beyond the second section, viewed along the direction of movement.

In another specific embodiment, viewed along the longitudinal direction of the fourth edge towards the second section, the distance from the first section to the second closing surface, viewed along a direction at right angles to the fourth edge and parallel to the decorative surface, decreases, preferably gradually, and preferably, viewed along the longitudinal direction of the fourth edge, the design of the second section is constant. Such a first section makes it possible reduce the distance between the decorative surfaces when coupling two panels to each other according to said downward movement, as a result of which coupling can be achieved in a simple manner. Such a first section also makes it possible to produce the coupling parts in a simple manner by means of one or more milling tools and/or other cutting tools during the linear displacement of said fourth edge along said one or more tools. Thus, for example, one or more of said tools can be arranged in such a way that they are displaceable along a direction of movement at right angles to the direction of linear displacement of the panel and parallel to the panel in order to change the distance to the edge in which the fourth edge with coupling parts is formed. Thus, it is possible first to form the second section during the linear displacement of the panel and then to (gradually) start moving a said milling or cutting tool away from the panel along the direction of movement in order to produce the first section. Also, during the linear displacement, it is possible to (gradually) start moving one or more of said tools away from the panel, in which case the transition between the first section and the second section can then be an arbitrary transition.

In a highly preferred embodiment, the fourth edge, at the location of the said lower portion, only comprises said first section, said second section and the optional transition section.

In a specific embodiment, viewed along the longitudinal direction of the fourth edge, the distance from the first section to the second closing surface and the distance from the second section to the second closing surface change gradually. In this case, the transition between the first section and the second section may have been chosen arbitrarily, with the first section and the second section for example each taking up half the entire length of the fourth edge, thus forming a first and a second half, respectively, in which case then, for example, the maximum distance from the fourth edge to the second closing surface, viewed along the longitudinal direction of the fourth edge from the first edge to the second edge, gradually decreases.

In a preferred embodiment, the horizontal locking elements comprise at least a first horizontal locking part which is present on the third edge and extends substantially in the longitudinal direction of the third edge, and a second horizontal locking part which is present on the fourth edge and extends substantially in the longitudinal direction of the fourth edge, wherein the first horizontal locking part extends on the proximal side of the upwardly directed locking element and the second horizontal locking part extends on the distal side of the downwardly directed recess, wherein, in the coupled state of two such panels, the first horizontal locking part of the one panel cooperates with the second horizontal locking part of the other panel and is in contact under pretension. Such a pretension can be created when there is an overlap between the downwardly directed recess and the upwardly directed locking element, in such a way that the fourth locking part has to push away the third locking part when coupling two such panels. More preferably, this results in elastic bending of the lip with the upwardly directed locking element, thus creating the pretension. Preferably, the first horizontal and the second horizontal locking part comprise inclined surfaces in order to facilitate the push-away action during mutual coupling.

According to a second aspect, the present invention relates to a method for forming a panel according to the first aspect of the invention, wherein the method comprises at least the following steps:

- moving the panel relative to cutting and/or milling tools; and
- treating the edges of the moving panel by means of the cutting and/or milling tools to produce at least some of the coupling parts. Preferably, the panel is moved along a direction which extends parallel to the edge to be treated or the opposite edges to be treated, and cutting and/or milling tools are arranged next to the edge or edges to be treated. Furthermore preferably, the two opposite edges which extend along said direction are both treated while moving, and cutting and/or milling tools are then also arranged at the location of the two opposite edges. Normally, a rectangular panel has two pairs of opposite edges to be treated. In order to treat the first pair of opposite edges, the panel is moved along a direction parallel to the first pair of opposite edges along said cutting and/or milling tools. In order to treat the second pair of opposite edges, the panel is then moved along a direction parallel to the second pair of opposite edges along said cutting and/or milling tools.

Preferably, during the treatment of the edge which will form the fourth edge, at least one of the cutting and/or milling tools will be moved towards and/or away from the panel in such a way that the depth of this cutting and/or milling tool in the panel changes in order to form said first and second section. The cutting and/or milling tools which are moved towards and/or away from the panel are preferably moved along a direction of movement which extends at right angles to the direction in which the panel is moved and in the plane of the panel, i.e. preferably at right angles to the edge to be treated and parallel to the decorative surface. The term depth indicates a direction at right angles to the fourth edge and in the plane of the panel. Preferably, only one said cutting and/or milling tool moves towards and/or away from the panel during the treatment of the edge which will form the fourth edge. This relates to a non-stationary cutting and/or milling tool. However, there may also be two or more of such non-stationary cutting and/or milling tools. Stationary cutting and/or milling tools have a constant position, although the milling tool will obviously rotate about a fixed shaft—i.e. a shaft which remains in a fixed position during milling of one panel, but may obviously assume another position so as to be able to mill other types of panels.

Furthermore preferably, said cutting and/or milling tool is moved away from the panel during the treatment of the edge which will form the fourth edge, so that the second section is formed first, followed by the first section. It is easier to move away from the panel when producing the fourth edge, since moving towards the panel could cause an undesired displacement of the panel.

Preferably, the coupling parts of the first pair of opposite edges are formed by means of stationary cutting or milling tools. Also preferably, the coupling parts of the third edge are formed by means of one or more stationary cutting or milling tools.

Furthermore preferably, the cutting or milling tools are rotating cutting or milling tools.

According to a third aspect, the invention relates to a panel, for example a floor panel or a wall panel, for forming a covering, such as a floor covering or wall covering, and optionally comprising one or more characteristic features of the first aspect, wherein this panel comprises a substrate and a top layer with a decorative surface, wherein the panel comprises a first pair of opposite edges and a second pair of opposite edges;

wherein the first pair of opposite edges defines a first edge and a second edge of the panel, and the second pair of opposite edges defines a third edge and a fourth edge of the panel;

wherein the first pair of opposite edges comprises coupling parts for coupling two such panels to each other, wherein these coupling parts have the following characteristic features:

the coupling parts optionally comprise a horizontally active locking system which, in a coupled state of two such panels, brings about a locking in the plane of the panels and at right angles to the respective edges;

the coupling parts comprise a vertically active locking system which, in a coupled state of two such panels, brings about a locking at right angles to the plane of the panels;

the coupling parts are configured in such a way that two such panels on these edges can be coupled to each other by means or a rotating movement;

wherein the second pair of opposite edges comprises coupling parts for coupling two such panels to each other, wherein these coupling parts have the following characteristic features:

the coupling parts comprise a horizontally active locking system with horizontally active locking parts which, in a coupled state of two such panels, brings about a locking in the plane of the panels and at right angles to the respective edges;

the coupling parts comprise a vertically active locking system with vertically active locking parts which, in a coupled state of two such panels, brings about a locking at right angles to the plane of the panels;

the coupling parts are formed as a single part with the material of the panel itself;

the coupling parts are at least formed by an upwardly directed lower hook-shaped portion which is situated on the third edge, and a downwardly directed upper hook-shaped portion which is situated on the fourth edge, wherein the lower hook-shaped portion consists of a lip with an upwardly directed locking element which, proximally therefrom, defines a female part in the form of an upwardly directed recess, whereas the upper hook-shaped portion consists of a lip with a downwardly directed locking element which forms a male part and which, proximally therefrom, defines a downwardly directed recess, wherein the upwardly directed locking element is designed to extend at least partly in the downwardly directed recess and the downwardly directed locking element is designed to extend at least partly in the upwardly directed recess;

the coupling parts are configured in such a way that two such panels can be coupled to each other by their respective edges by means of a downward movement of the one panel with respect to the other panel;

the vertically active locking parts are at least formed by a first locking part which is present on the aforementioned third edge and extends substantially in the longitudinal direction of the third edge, and a second locking part which is present on the aforementioned fourth edge and extends substantially in the longitudinal direction of the fourth edge, wherein, in the coupled state of two such panels, the first locking part of the one panel cooperates with the second locking part of the other panel; and the first locking part and the second locking part are situated at levels which are higher than a bottom of the upwardly directed recess;

wherein, in addition, the panel has the following combination of characteristic features on the second pair of opposite edges:

the first locking part is situated on the proximal side of the female part and is in this case present on this proximal side in a solid manner;

the second locking part is situated on the distal side of the male part and is in this case preferably also present on this distal side in a solid manner; and at least one of the locking parts of the pair of locking parts which is formed by the first locking part and the second locking part is of a variable design in the longitudinal direction of the respective edge, wherein preferably said variable design provides for the cross section of at least one of the locking parts of the aforementioned pair of locking parts to vary and the variable design is configured in such a way that, in a coupled state, the transverse overlap (OT) between the first locking part and the second locking part varies in the longitudinal direction.

With this definition, the expression "present in a solid manner" has to be understood to mean that no weakened sections and/or recesses are provided behind the respective locking part, at least no weakened sections and/or recesses which are intended to allow certain deformations. More particularly, this is understood to mean that no weakened sections and/or recesses of the type as known from, inter alia, WO2011/001326 are used.

Due to the fact that the variable design is used on one or more locking parts which, in contrast to what is known from WO2010/100046, are now not situated at the distal end of the lower lip, these locking parts are better situated to be pressed one after the other, resulting in a stronger and stabler snap coupling. Due to the use of a variable design, the constructor is provided with an additional parameter to improve the panels and a heavier snap coupling can be used, for example, at certain locations along the respective edges than at other locations. In this way, it is possible to achieve a better locking effect using strong local snapping coupling parts, whereas overall the required joining force remains limited due to the fact that the coupling is weakened in other locations.

Preferably, the aforementioned variable design provides for the cross section of at least one of the locking parts of the aforementioned pair of locking parts to vary.

According to the most preferred embodiment of the third aspect of the invention, the variable design is configured in such a way that, in the coupled state, the transverse overlap between the first locking part and the second locking part, and in particular of the respective contact surfaces thereof, varies in the longitudinal direction.

The verb "vary" also means that the overlap may be zero in certain locations and therefore is not present.

It will be clear that the expression a "variable design" is understood to refer to a design which is the result of a specific modification. Edge variations which result from the profiling convergence at corners of panels are not considered to qualify for such variable design.

The aforementioned variation may provide for at least one of the longitudinal ends of the second pair of edges, and optionally for both ends, to not have an overlap or to have an overlap which is smaller than at a location which is situated at a greater distance from the respective end.

Furthermore, the overlap may gradually change from a state of no overlap or a state of a smaller overlap to the state of a greater overlap.

Also, the state of no overlap or the state of a smaller overlap may be situated at that end which is located against the edge of the first pair of edges by means of which the panel is intended to be coupled to a preceding row of already laid panels.

Said aforementioned variation may provide for the overlap to be smaller or non-existent in one or more locations between the longitudinal ends, between two locations where an overlap does exist.

Furthermore, there may be an overlap in at least three locations, in each case with an overlap in between which is smaller and/or non-existent.

The variation in overlap may be provided for in at least one or more gradual transitions.

The variation in overlap may be provided for in at least one or more stepwise transitions.

In a preferred embodiment, one locking part of the pair formed by the aforementioned first and second locking parts has the aforementioned variation, whereas the other locking part has the same continuous cross-sectional shape along the entire or virtually the entire length of the respective edge, or alternatively, this other locking part at least has the same continuous shape in those locations where the first-mentioned locking element varies.

Preferably, the locking part which has the aforementioned variations is formed by the first locking part or the locking part which has the aforementioned variations is formed by the second locking part.

In another embodiment, both the first locking part and the second locking part have the aforementioned variations.

In a highly preferred embodiment, the first locking part and the second locking part are provided with contact surfaces and the aforementioned variable design provides for the contact surface of the first locking part and/or the contact surface of the second locking part to change in angular position or shape.

Furthermore preferably, the contact surfaces are configured in such a way that at least the angle of the tangent line which is defined by the contact surfaces in the coupled position varies in the longitudinal direction.

Also preferably, the contact surfaces are configured in such a way that at least the position where the contact surfaces come into contact with each other, viewed in the height and/or transverse direction, varies depending on the longitudinal direction.

Preferably, the coupling parts on the first pair of edges and the coupling parts on the second pair of edges are configured in such a way that they can be installed by means of the so-called fold-down technique.

In a preferred embodiment, the second pair of edges also has a vertically active locking part present on the proximal side of the downwardly directed hook-shaped portion which can then cooperate with a locking part on the upwardly directed hook-shaped portion. The latter locking part is preferably situated on the distal end of the upwardly directed hook-shaped portion.

Preferably, the first locking part and/or the second locking part consists of one or more portions, as a result of which, in the coupled state, one or more overlap zones are formed between the first locking part and the second locking part; such overlap zone is characterized by a maximum transverse overlap (OT) and a maximum longitudinal overlap (OL); and the maximum longitudinal overlap (OL) satisfies at least one of following, and preferably several of following criteria for at least one overlap zone:

the longitudinal overlap (OL) is at least 3 millimetres;

the longitudinal overlap (OL) is at least 5 millimetres;

the longitudinal overlap (OL) is at least 10 millimetres;

the longitudinal overlap (OL) is at least 20 millimetres;

the longitudinal overlap (OL) is at least 3 times the size of the transverse overlap (OT);

the longitudinal overlap (OL) is at least 10 times the size of the transverse overlap (OT);

the longitudinal overlap (OL) is at least 100 times the size of the transverse overlap (OT);

the longitudinal overlap (OL) is so large that, at the location of the centre of the longitudinal overlap (OL), the compressibility of the locking portions is essentially not affected by any absence of material at the longitudinal ends of the overlap zone.

Furthermore preferably, several overlap zones are present on the respective edges, and the majority thereof and preferably all overlap zones satisfy one or more of the aforementioned criteria.

The panels according to the first aspect and the panels according to the third aspect may be of a different construction, so these panels may be, for example:

laminate panels in which the top layer comprises, for example, one or more resin-impregnated papers and the substrate is, for example, a wood-based substrate, such as a wood fibreboard—Medium Density Fibreboard or High Density Fiberboard—, or a particleboard;

parquet panels or veneer parquet panels, comprising a wood layer which is covered with one or more protective layers, such as for example lacquer layers on the basis of a resin and/or lacquer and/or an oil, to protect the wood layer;

panels on the basis of polyvinyl chloride (PVC) or another thermoplastic material, such as LVT (luxury vinyl tile), WPC (wood plastic composite), EPC (expanded polymer core), SPC (solid particle core), etc.;

panels comprising a mineral-based substrate, such as a substrate based on plaster, magnesium oxide (MgO) or cement, and a top layer on the basis of plastic;

panels comprising a substrate on the basis of a geopolymer and a top layer on the basis of plastic;

panels on the basis of a plastic, in which this plastic is not PVC, for example on the basis of polyethylene terephthalate (PET), polyethylene (PE), polypropylene (PP), BMC (bulk mounding compound) on the basis of unsaturated polyesters, polycarbonate (PC), acrylonitrile butadiene styrene (ABS), styrene-ethylene-butylene-styrene (SEBS), polylactic acid (PLA), polyvinyl butyral (PVB), etc.

The substrate of the panels may be a composite substrate which at least consists of two substrate layers, each of a well-defined thickness, for example a first plastic-based substrate layer and a second substrate layer which is situated above the former, preferably directly above, and has a thickness of, for example, at least 0.5 mm, preferably at least 1 mm; wherein this composite substrate preferably also has one of the following characteristic features or any combination of these characteristic features:

the density of the first substrate layer is different from the density of the second substrate layer, and preferably the second substrate layer has a higher density than the first substrate layer;

the first substrate layer is foamed, and preferably of the closed-cell-type and still more preferably of the so-called hard-foam-type, and preferably the second substrate layer is not or less foamed than the first substrate layer;

the first substrate layer is extruded as board material or is formed to be a board by means of a scattering process and consolidation of the scattered material to form a board;

the second substrate layer consists of an extruded layer or of a layer which has been formed by means of a scattering process and consolidation of the scattered material;

both substrate layers are glued to each other or are, alternatively, consolidated in the same production process, the latter for example by directly attaching the materials of the substrates to each other or, for example, also by producing them from one composite mass with at least two layers;

the composite substrate has a total thickness of 3 to 10 mm.

BRIEF DESCRIPTION OF THE DRAWINGS

With a view to providing a better illustration of the characteristic features of the invention, the following text describes a number of preferred embodiments by way of example, without any limiting nature, with reference to the appended drawings, in which.

DETAILED DESCRIPTION OF THE INVENTION

Figure 1:
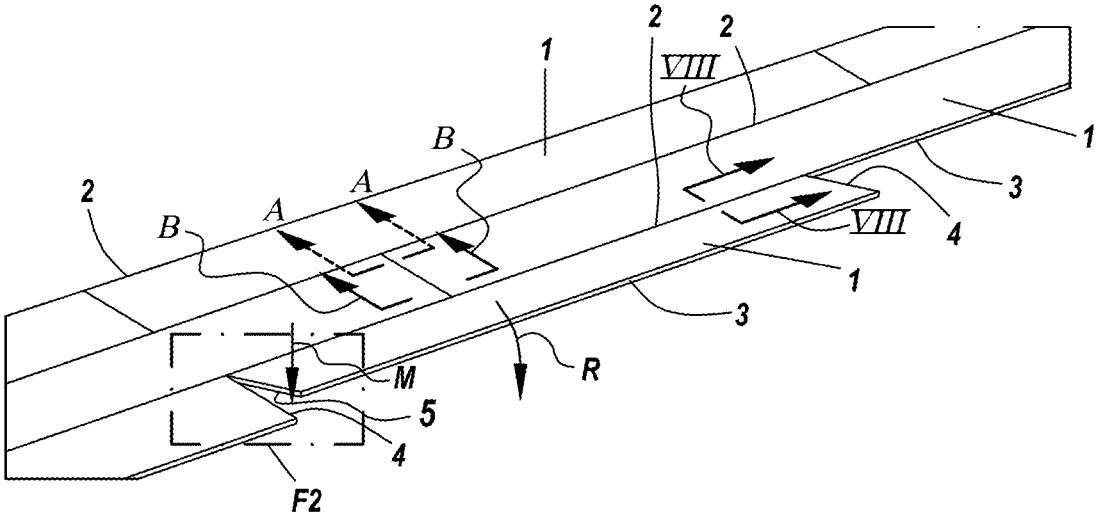
FIG. 1 diagrammatically and in perspective shows a portion of a floor covering which consists of floor panels according to the invention during formation of the floor covering.
Figure 2:
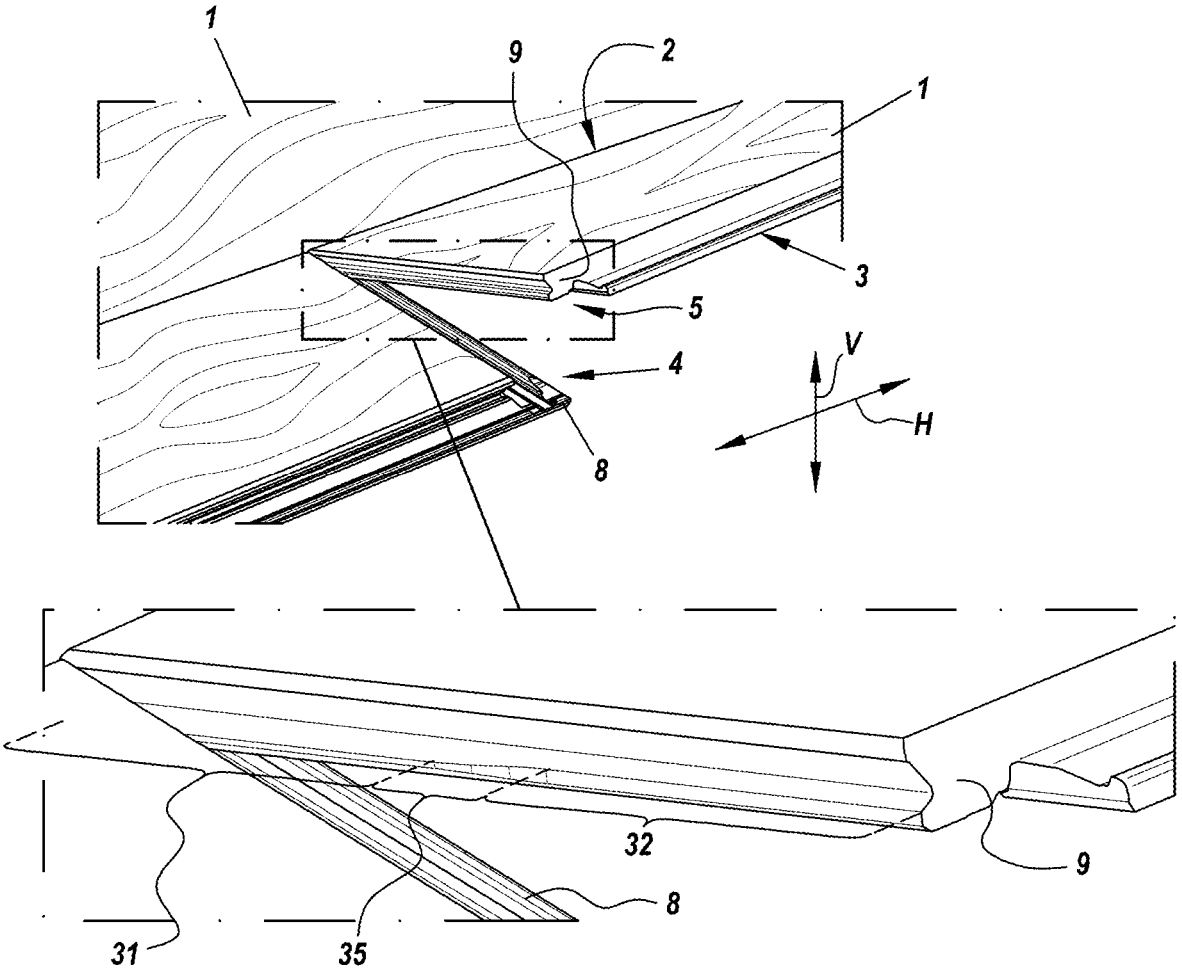
FIG. 2 shows the portion which is indicated by F2 in FIG. 1 on an enlarged scale, with the panels being according to the first aspect.

As is illustrated in FIGS. 1 and 2, the invention relates to panels 1, such as floor panels, for forming a covering. These floor panels 1 comprise a first pair of opposite edges 2-3, as well as a second pair of opposite edges 4-5.

Along their edges, the illustrated floor panels 1 are configured in such a way that they are couplable to each other according to the so-called fold-down principle which consists in the possibility of such floor panels 1 to be coupled to each other along the first pair of opposite edges 2-3 by means of a rotating movement R, and to be coupled to each other along the second pair of opposite edges 4-5 by means of a downward movement M, the downward movement M being the result of the rotating movement R and thus coming about substantially simultaneously. In this case, the floor panels 1 are also configured in such a way along their edges 2-3 and 4-5 that ultimately a locking in both the vertical direction V and the horizontal direction H is brought about, the latter at right angles to the respective edges 2-3 and 4-5.

The first pair of opposite edges 2-3 defines a first edge 2 and a second edge 3 of the floor panel 1, whereas the second pair of opposite edges 4-5 defines a third edge 4 and a fourth edge 5 of the floor panel 1.

As is illustrated, such a floor panel 1 is to this end provided with coupling parts 6-7 on its first pair of opposite edges 2-3, whereas coupling parts 8-9 are provided on the second pair of opposite edges 4-5, which coupling parts are described in more detail below with reference to the figures.

Figure 8:
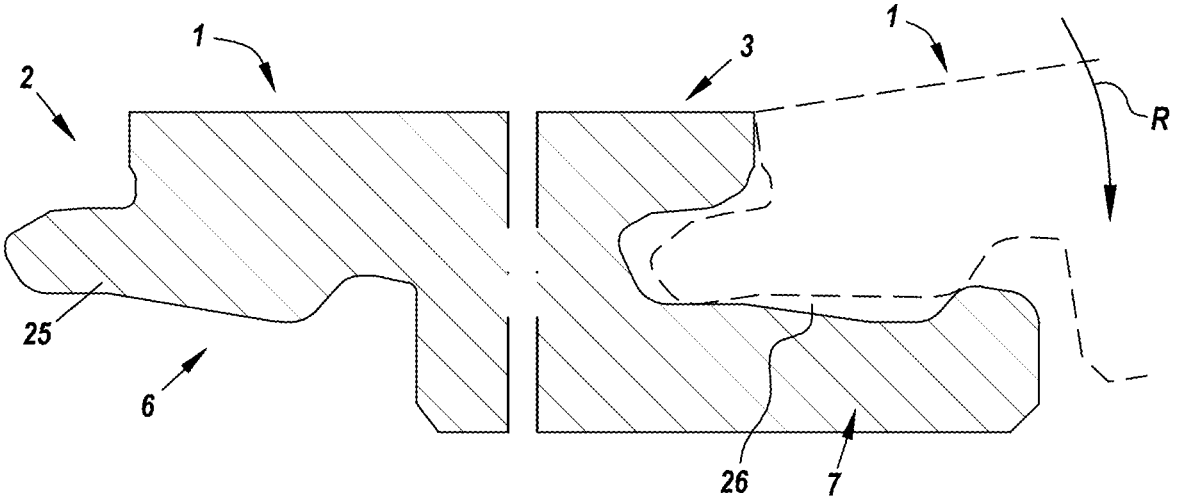
FIG. 8 shows a possible cross section along lines VIII-VIII.
Figure 9:
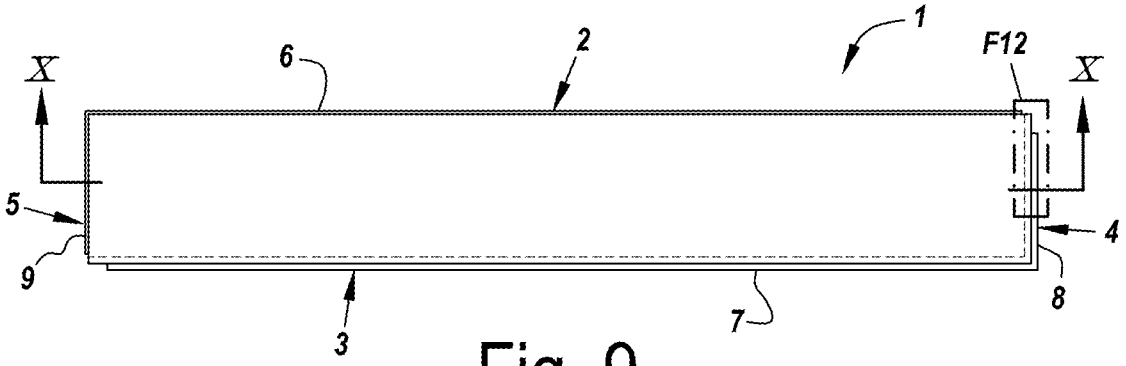
FIG. 9 diagrammatically shows a top view of a floor panel according to the third aspect of the invention.

The coupling parts 6-7 of the first pair of opposite edges 2-3 show, both in the embodiments according to the first aspect and the third aspect illustrated here, as can be seen in FIG. 8, at least the following basic characteristic features:

- the coupling parts 6-7 comprise a horizontally active locking system which, in a coupled state of two such floor panels 1, brings about a locking in the plane of the floor panels 1 and at right angles to the respective edges 2-3;
- the coupling parts 6-7 also comprise a vertically active locking system which, in a coupled state of two such floor panels 1, brings about a locking at right angles to the plane of the floor panels 1;
- the coupling parts 6-7 are produced as a single part with the material of the floor panel 1 itself; and
- the coupling parts 6-7 are configured in such a way that two such panels 1 on these edges can be coupled to each other by means of a rotating movement R.

FIGS. 2 to 7 show possible embodiments of the first aspect of the invention. As can be seen in FIGS. 2 to 7, the coupling parts 8-9 of the second pair of opposite edges 4-5 at least have the following basic characteristic features:

- the coupling parts 8-9 comprise a horizontally active locking system with horizontally active locking parts which, in a coupled state of two such panels 1, brings about a locking in the plane of the panels 1 and at right angles to the respective edges 4-5;
- the coupling parts 8-9 comprise a vertically active locking system with vertically active locking parts which, in a coupled state of two such panels 1, brings about a locking at right angles to the plane of the panels 1;
- the coupling parts 8-9 are at least composed of an upwardly directed lower hook-shaped portion 10 which is situated on the third edge 4, and a downwardly directed upper hook-shaped portion 11 which is situated on the fourth edge 5, wherein the lower hook-shaped portion 10 consists of a lip 12 with an upwardly directed locking element 13 which, proximally therefrom, defines a female part in the form of an upwardly directed recess 14, whereas the upper hook-shaped portion 11 consists of a lip 15 with a downwardly directed locking element 16 which forms a male part and which, proximally therefrom, defines a downwardly directed recess 17, wherein the upwardly directed locking element 13 is designed to extend at least partly in the downwardly directed recess 17 and the downwardly directed locking element 16 is designed to extend at least partly in the upwardly directed recess 14;
- the coupling parts 8-9 are configured in such a way that two such panels 1 can be coupled to each other along their respective edges 4-5 by means of a downward movement M of the one panel 1 with respect to the other panel 1;
- the third edge 4 comprises an upright first closing surface which extends substantially in the longitudinal direction of the third edge 4, and the fourth edge 5 comprises an upright second closing surface which is complementary to the first closing surface and extends substantially in the longitudinal direction of the fourth edge 5, wherein, in the coupled state of two such panels 1, the first closing surface of the one panel 1 bears against the second closing surface of the other panel 1, both together thus forming an upright closing surface S, this closing surface S extending between the decorative surfaces and the vertically and horizontally active locking parts;
- wherein the second closing surface extends upright from a lower point, wherein a plane A which extends parallel to the decorative surface and through this lower point divides the downwardly directed locking element 16 into an upper portion 29 and a lower portion 30 which adjoins this upper portion 29, so that the lower portion 30 is delimited by a distal side and a proximal side, as well as by a bottom of the downwardly directed locking element 16, this lower portion 30 being designed to extend at least partly in the upwardly directed recess 14;
- viewed along the longitudinal direction of the fourth edge 5, the lower portion 30 of the downwardly directed locking element 16 comprises a first section 31 and a second section 32, wherein, viewed along a direction parallel to the decorative surface and at right angles to the fourth edge 5, the distal side of the first section 31 extends beyond the distal side of the second section 32 and beyond the second closing surface;
- the fourth edge 5, viewed along the longitudinal direction of the fourth edge 5 from the first edge 2 to the second edge 3, comprises a first half and a second half which adjoins the first half, wherein the first section 31 extends at the location of the first half and the first section 31 extends between the first edge 2 and the second section 32, and wherein the second section 32 extends at the location of the second half;
- viewed along the longitudinal direction of the fourth edge 5, the length of the first section 31 is at least 20% of the total length of the fourth edge 5, preferably at least 30% and most preferably virtually 40%;
- viewed along a direction parallel to the decorative surface and at right angles to the fourth edge 5, the distal side of the second section 32 extends beyond the second closing surface and/or at least partly extends at the location of the second closing surface;
- the first closing surface and the second closing surface extend virtually at right angles to the decorative surface and the closing surface S extends virtually at right angles to the decorative surface;
- viewed along the longitudinal direction of the third edge 4, the design of the upwardly directed recess 14 is virtually constant;
- viewed along the longitudinal direction of the fourth edge 5, the design of the upper portion 29 of the downwardly directed locking element 16 and the design of the downwardly directed recess 17 is virtually constant;
- the lower portion 30 of the downwardly directed locking element 16 of the fourth edge 5 comprises a bottom portion at the bottom which is delimited at the bottom by the bottom of the downwardly directed locking element 16 and is designed to extend in the upwardly directed recess 14 of the third edge 4, with this bottom portion, at least at the location of the first section 31 and preferably along the entire longitudinal direction, forming the most distal portion of the downwardly directed locking element 16, and at least a portion of the proximal side of the upwardly directed recess 14 of the third edge 4 extends proximally from and at a distance from the first closing surface, so that the bottom portion is accommodable in the upwardly directed recess 14;

the horizontal locking elements comprise at least a first horizontal locking part 36 which is present on the third edge 4 and extends substantially in the longitudinal direction of the third edge 4, and a second horizontal locking part 37 which is present on the fourth edge 5 and extends substantially in the longitudinal direction of the fourth edge 5, wherein the first horizontal locking part 36 extends on the proximal side of the upwardly directed locking element 13 and the second horizontal locking part 37 extends on the distal side of the downwardly directed recess 17, wherein, in the coupled state of two such panels 1, the first horizontal locking part 36 of the one panel 1 cooperates with the second horizontal locking part 37 of the other panel 1 and this with or without pretension;

viewed along the longitudinal direction of the fourth edge 5, the design of the first section 31 and the second section 32 is preferably constant, wherein the first section 31 directly adjoins the second section 32, or a transition section 35 is present which gradually spans the distance between the first section 31 and the second section 32, viewed along a direction parallel to the decorative surface and at right angles to the fourth edge 5, and this viewed along the longitudinal direction of the fourth edge 5.

Figure 3:
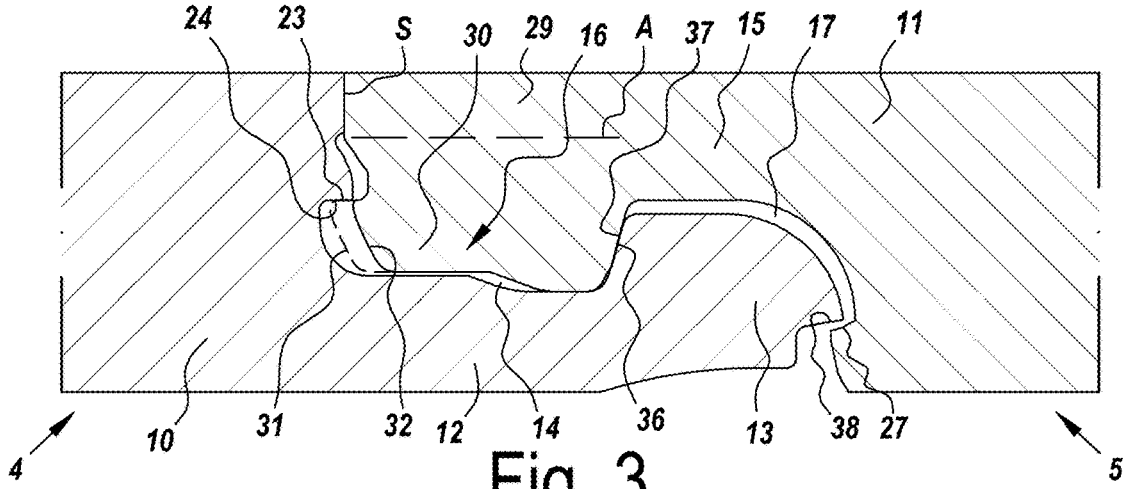
FIGS. 3 to 7 shows possible cross sections along lines B-B and lines A-A (in dashed lines) of possible embodiments of panels according to the first aspect of the invention.
Figure 4:
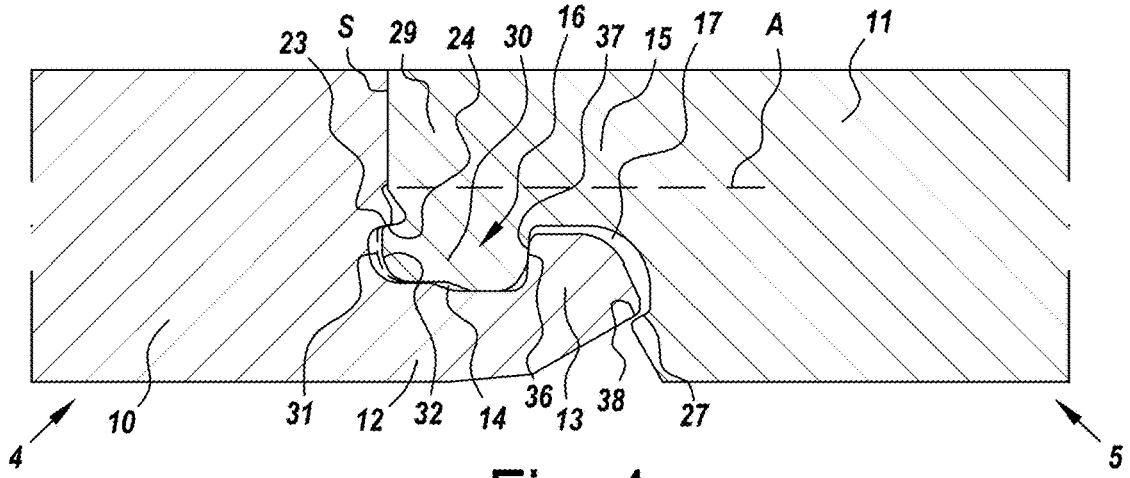

As can be seen in FIGS. 3 and 4, the coupling parts 8-9 of the second pair of opposite edges 4-5 have further characteristic features:

the vertically active locking parts at least comprise a first locking part 23 which is present on the third edge 4 and extends substantially in the longitudinal direction of the third edge 4, and a second locking part 24 which is present on the fourth edge 5 and extends substantially in the longitudinal direction of the fourth edge 5, wherein, in the coupled state of two such panels 1, the first locking part 23 of the one panel 1 cooperates with the second locking part 24 of the other, wherein the first locking part 23 is situated on the proximal side of the female part and the second locking part 24 is situated on the distal side of the bottom portion.

the coupling parts 8-9 of the second pair of opposite edges 4-5 are formed as a single part with the material of the panel 1 itself, and the first locking part 23 is present on the proximal side of the female part in a solid manner and the second locking part 24 is present on the distal side of the bottom portion in a solid manner;

the second locking part 24 forms part of the bottom portion, and preferably the first and the second locking part 23-24 form cooperating locking faces, these locking faces extending virtually parallel to the horizontal plane;

the vertical locking elements at least comprise a third locking part 38 which is present on the third edge 4 and extends substantially in the longitudinal direction of the third edge 4, and a fourth locking part 27 which is present on the fourth edge 5 and extends substantially in the longitudinal direction of the fourth edge 5, wherein the third locking part 38 extends on the distal side of the upwardly directed locking element 13 and the fourth locking part 27 extends on the proximal side of the downwardly directed recess 17, wherein, in the coupled state of two such panels 1, the third locking part 38 of the one panel 1 can be brought into cooperation with the fourth locking part 27 of the other panel 1.

Figure 5:
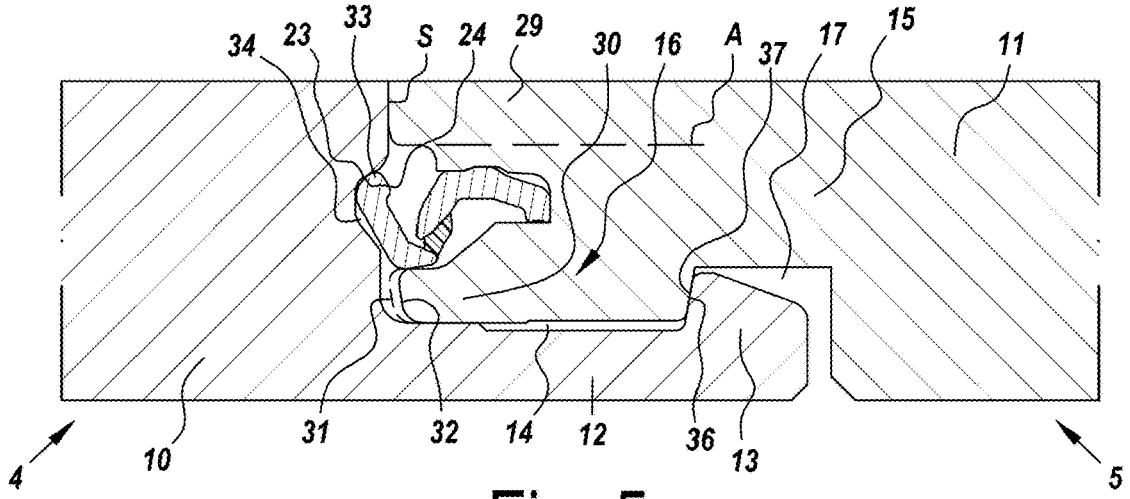
Figure 6:
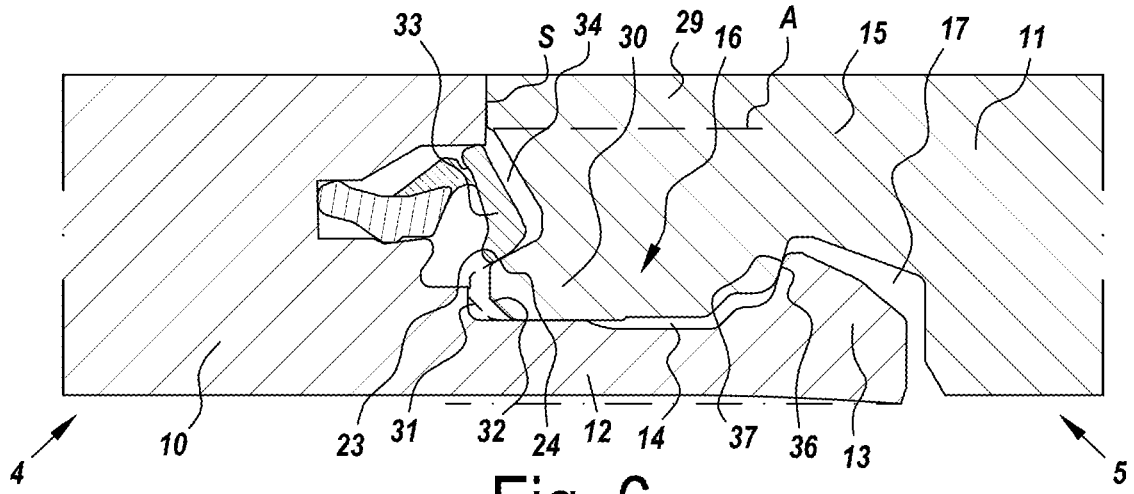
Figure 7:
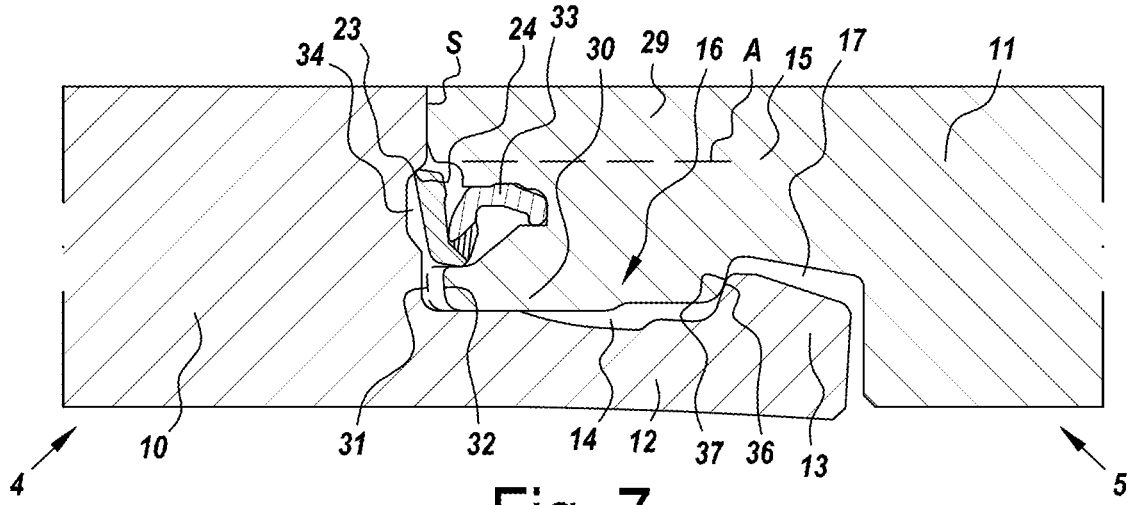

As can be seen in FIGS. 5 to 7, the coupling parts 8-9 of the second pair of opposite edges 4-5 have further characteristic features:

the coupling parts 8-9 of the second pair of opposite edges 4-5 comprise at least a separate locking element 33 which, in a coupled state, cooperates with a locking groove 34 of the coupling parts 8-9 in order to partly or completely form the vertically active locking parts;

the locking element 33, at least in a coupled state, bears against the bottom portion;

with the embodiment illustrated in FIG. 6, the third edge 4 comprises the separate locking element 33 and the locking groove 34 is present in the fourth edge 5, wherein the upper side of the bottom portion delimits the underside of the locking groove 34 and wherein, in a coupled state, the separate locking element 33 is in contact with the upper side of the bottom portion and thus forms the first and the second vertically active locking part 23-24, respectively;

with the embodiments illustrated in FIGS. 5 and 7, the fourth edge 5 comprises the separate locking element 33 and the locking groove 34 is present in the third edge 4;

as can be seen in FIGS. 6 and 7, the lip 12 of the third edge 4 is bent in the coupled state of two panels 1 and there is therefore a case of pretension.

As can be seen in FIG. 8, the first pair of opposite edges 2-3 comprises a tongue 25 which is situated on the first edge 2, and a groove 26 which is situated on the second edge 3.

FIGS. 9 to 21 illustrate the third aspect of the invention.

Figure 10:
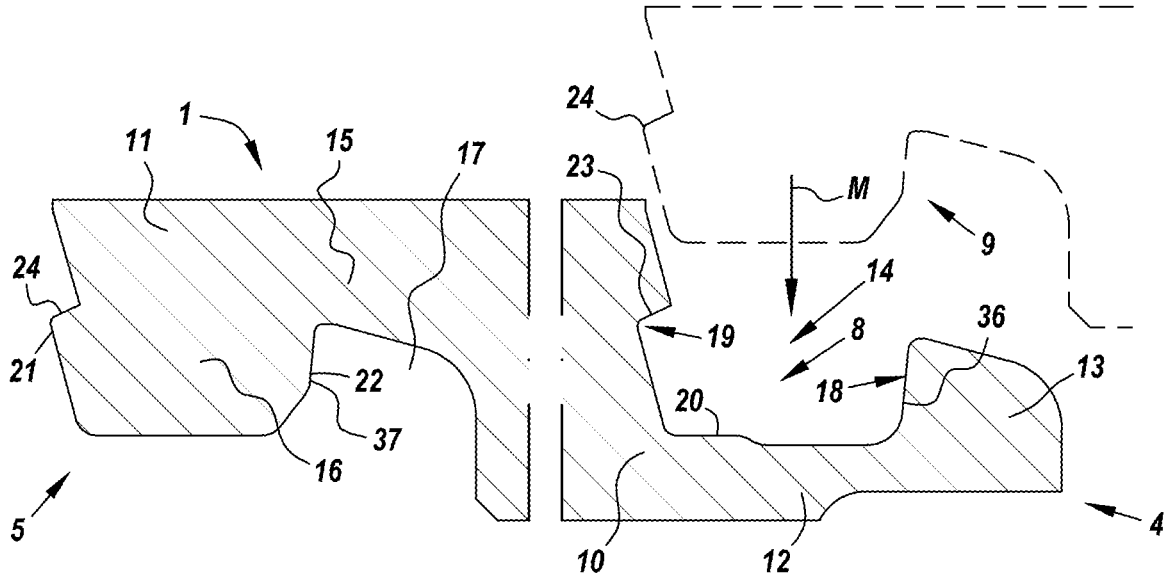
FIG. 10 shows a cross section along lines X-X.
Figure 11:
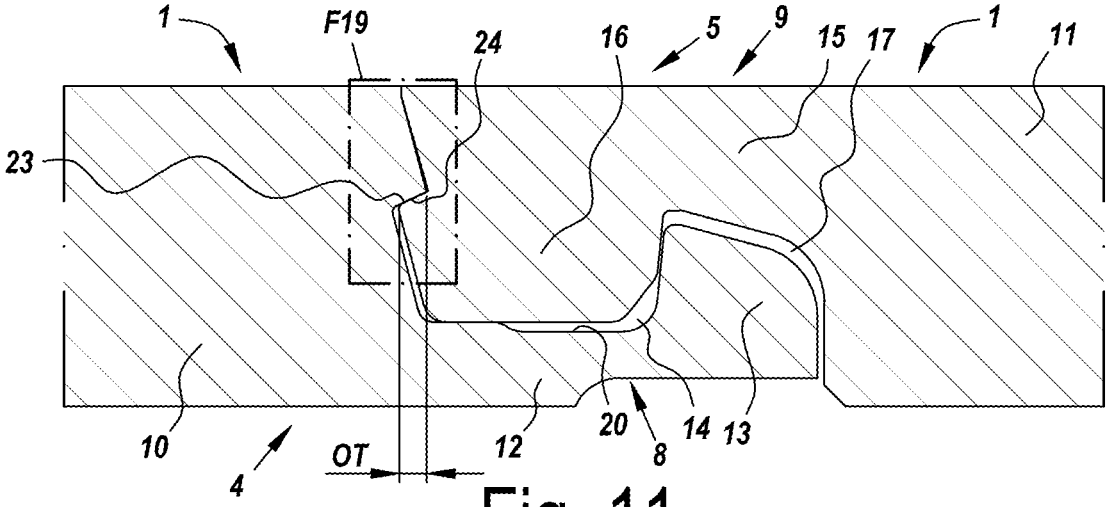
FIG. 11 shows the coupling parts visible in FIG. 10 on an enlarged scale in the coupled state.

As can be seen in FIGS. 10 and 11, the coupling parts 8-9 of the second pair of opposite edges 4-5 have at least the following basic characteristic features:

the coupling parts 8-9 comprise a horizontally active locking system which, in a coupled state of two such floor panels 1, brings about a locking in the plane of the floor panels 1 and at right angles to the respective edges 4-5;

the coupling parts 8-9 also comprise a vertically active locking system which, in a coupled state of two such floor panels 1, brings about a locking at right angles to the plane of the floor panels 1;

the coupling parts 8-9 are formed as a single part with the material of the floor panel 1 itself;

the horizontally active locking system of the second pair of opposite edges 4-5 is at least composed of an upwardly directed lower hook-shaped portion 10 which is situated on one of aforementioned two edges 4, as well as a downwardly directed upper hook-shaped portion 11 which is situated on the opposite edge 5, wherein the lower hook-shaped portion 10 consists of a lip 12 with an upwardly directed locking element 13 which, proximally therefrom, defines a female part in the form of an upwardly directed recess 14, whereas the upper hook-shaped portion 11 consists of a lip 15 with a downwardly directed locking element 16 which forms a male part;

the coupling parts 8-9 are configured in such a way that two such floor panels 1 can be couple to each other along their respective edges 4-5 by means of a downward movement M of the one panel 1 with respect to the other panel 1;

the aforementioned female part is delimited by a distal side 18 and a proximal side 19, as well as by a bottom 20 which is formed by the upper side of the lip 12 of the lower hook-shaped portion 10;

the aforementioned male part is delimited by a distal side 21 and a proximal side 22;

the vertically active locking system comprises vertically active locking parts;

the vertically active locking parts are at least formed by a first locking part 23 which is present on the aforementioned third edge 4 and extends substantially in the longitudinal direction of the third edge 4, and a second locking part 24 which is present on the aforementioned fourth edge 5 and extends substantially in the longitudinal direction of the fourth edge 5, wherein, in the coupled state of two such floor panels 1, the first locking part 23 of the one floor panel 1 cooperates with the second locking part 24 of the other floor panel 1; and the first locking part 23 and the second locking part 24 are situated at levels which are higher than the aforementioned bottom 20 of the female part.

The peculiarity of the present invention is that the floor panel 1 furthermore has the following combination of characteristic features on the second pair of opposite edges 4 5:

the first locking part 23 is situated on the proximal side 19 of the female part and is in this case present on this proximal side 19 in a solid manner;

the second locking part 24 is situated on the distal side 21 of the male part and is in this case preferably also present on this distal side 21 in a solid manner; and at least one of the locking parts 23-24 of the pair of locking parts which is formed by the first locking part 23 and the second locking part 24 is of a variable design in the longitudinal direction of the respective edge.

It should be noted that the proximal side 19 of the female part, as is illustrated in the figures, is that side 19 which is situated closest, i.e. most proximal, to the centre of the floor panel 1.

In this description, the proximal side 19 has to regarded as extending across the entire height from the bottom 20 up to the upper side of the floor panel 1. When reference is made to the distal side 21 of the male part, this is understood to mean the entire distal side of the upper hook-shaped portion 11, i.e. the side from the underside of the male part up to the upper side of the floor panel 1.

The variable design intended by the invention will be explained by means of a number of illustrated embodiments and with reference to FIGS. 12 to 15.

Figure 12:
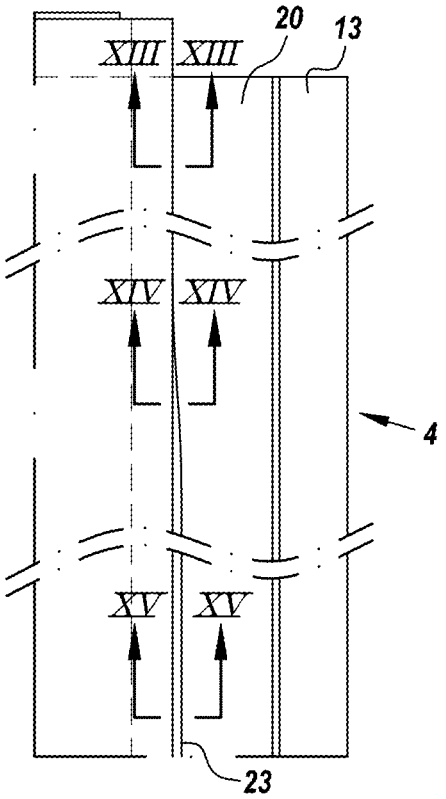
FIG. 12 shows a view of the portion which is indicated by F12 in FIG. 9 on an enlarged scale.
Figure 13:
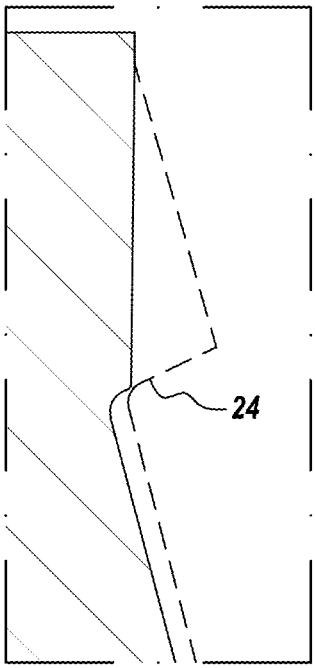
FIGS. 13, 14, 15 show cross sections on an enlarged scale, respectively along lines XIII-XIII, XIV-XIV and XV-XV in FIG. 12.
Figure 14:
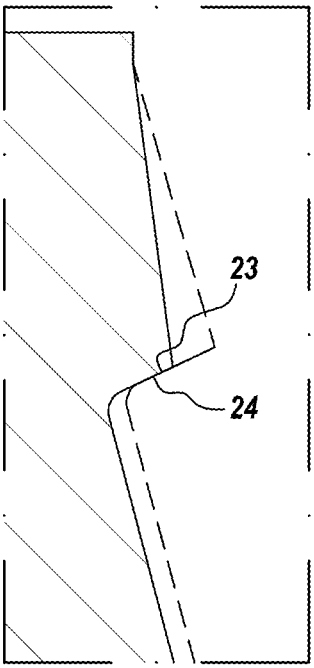
Figure 15:
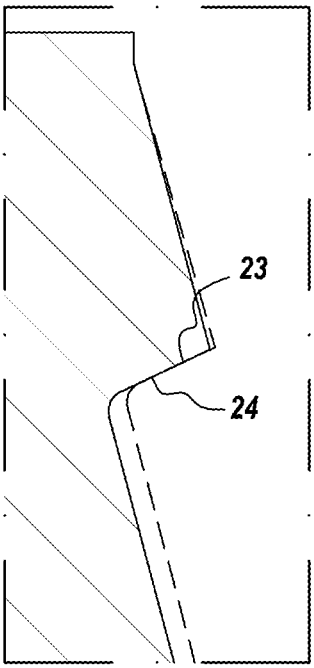

In the example of FIGS. 12 to 15, the form of the first locking part 23 varies in such a way that, in the coupled state, the transverse overlap between the first locking part 23 and the second locking part 24, and in particular of the respective contact surfaces thereof, varies in the longitudinal direction. In this example, the overlap varies between a state in which it is non-existent and a maximum state, i.e. from the end of the third edge 4 towards the centre of the edge. The course of this variation which, in this example, occurs gradually can be seen in FIG. 12, as well as from the specific cross sections which are illustrated in FIGS. 13, 14 and 15. In FIG. 13, there is no overlap of the contact surfaces, in FIG. 14 there is a slight overlap, and in FIG. 15 the maximum overlap used is shown. It will be clear that in the embodiment from FIGS. 12 to 15, only the design of the first locking part 23 varies, whereas the design of the second locking part 24 remains constant or virtually constant along the entire length.

The gradual variation, in the particular the gradual increase in the overlap, offers the advantage that the second locking part 24 is guided behind the first locking part 23 in a smoother manner during the rotating movement from FIG. 2. The risk of two floor panels 1 being pushed apart at the start of the rotation due to the locking parts 23-24 being pushed along each other, which may result in permanent gaps, is also reduced.

Due to the fact that the variable design is used on one or more locking parts 23-24, in this case the aforementioned first locking part 23 which, in contrast to what is known from WO2010/100046, are now not situated at the distal end of the lower lip, these locking parts are situated in a better position to be pressed one after the other, resulting in a stronger and stabler snap coupling.

Figure 16:
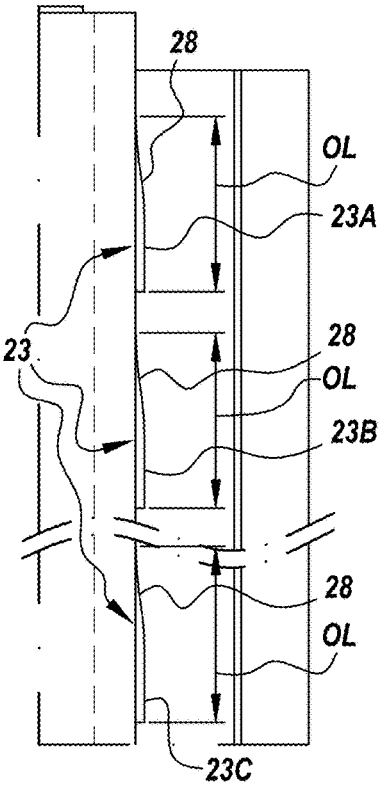
FIGS. 16, 17 and 18 diagrammatically show variants of the embodiment illustrated in FIG. 12.
Figure 17:
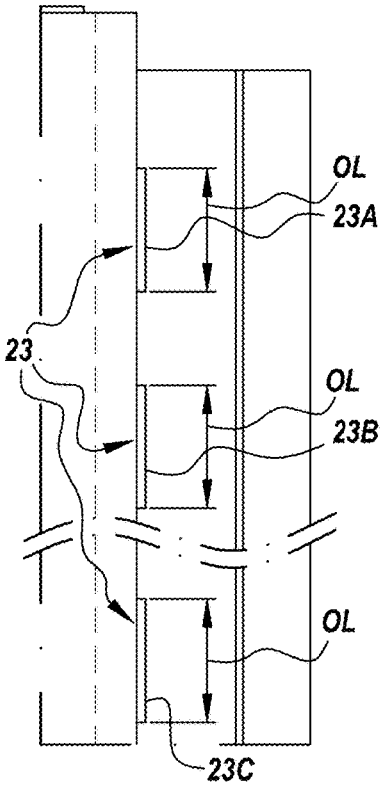

FIGS. 16 and 17 show variants in which the first locking part 23 varies by the fact that it is in each case composed of several spaced apart locking portions 23A-23B-23C, wherein the first locking part in the intermediate areas may be regarded as a "missing locking part" and may be regarded as a "present locking part" at the location of the aforementioned portions, so that, viewed overall, there is a variation. It will be clear that when such a first locking part 23 from FIGS. 16 and 17 is used in combination with a second locking part 24 having the same continuous shape which continues along the respective edge, this will result in a varying overlap at the contact surfaces in the coupled state.

In the embodiment from FIG. 16, gradual transitions 28 are used, whereas stepwise transitions are used in FIG. 17.

Figure 18:
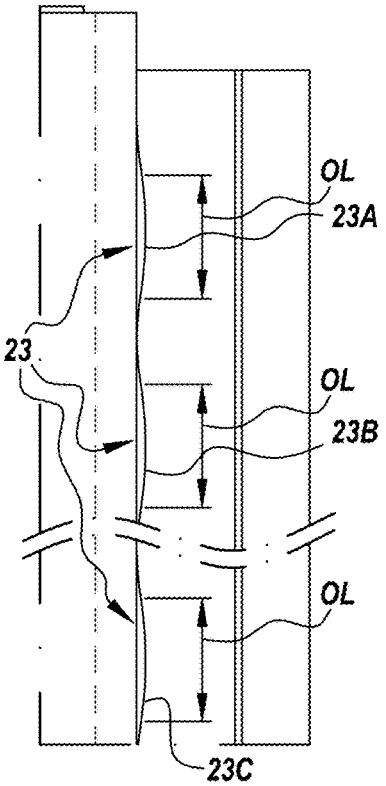

FIG. 18 illustrates another variant in which the first locking part 23 is configured to have an oscillating shape.

Figure 19:
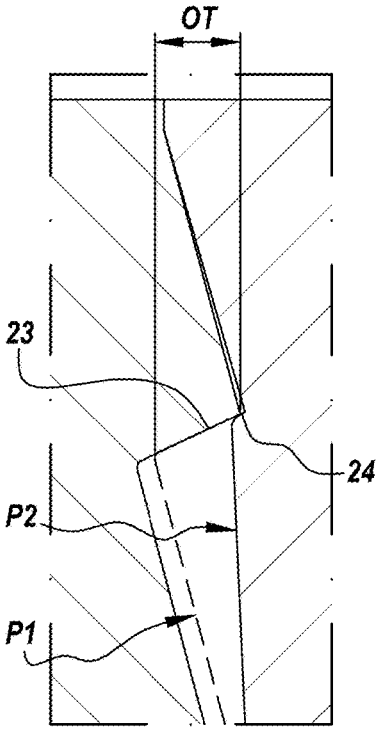
FIG. 19 shows another variant in a view similar to that of FIG. 13.

FIG. 19 shows that the varying overlap can also be achieved by making the second locking part 24 of a varying design depending on the longitudinal direction of the edge. In this case, the second locking part 24 varies between a position P1 in which there is an overlap, with a shape as shown by the dashed line, and a position P2 in which the overlap is zero or is virtually zero, as shown by a solid line in FIG. 19. In this case, it is the aim for the first locking part 23 to have a continuous path of the same shape.

Figure 20:
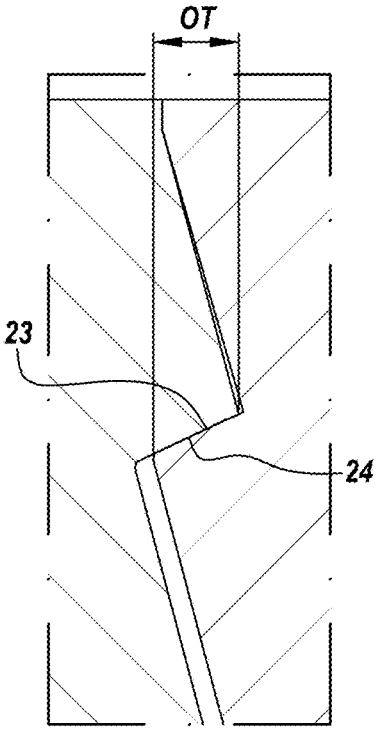
FIGS. 20 and 21 show yet another variant.
Figure 21:
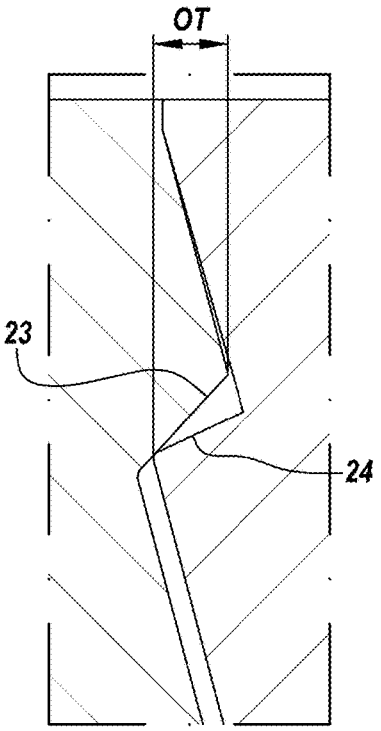

FIGS. 20 and 21 show a variant which varies in that the angular position of the contact surface of the first locking part 23 varies. In this case, FIGS. 20 and 21 show cross sections at two locations along the same pair of edges. FIG. 20 shows a normal position in which the respective contact surfaces are positioned against one another. FIG. 21 shows the position of the contact surfaces at another location, in which the second locking part 24 only touches the contact surface of the first locking part 23 at a corner. The shape from FIG. 21 may, for example, be used at the start of an edge in such a way that, for example in combination with the fold-down technique, the second locking part 24 can be brought underneath the first locking part 23 more quickly.

According to yet another possibility, the contact surfaces of both locking parts 23-24 remain parallel, but the mutual angle which they assume depending on the location on the edge varies.

The invention can be used with all kinds of floor panels 1. However, it is particularly suitable for relatively thin panels 1 with a thickness of less than 1 cm.

The invention according to the first, second or third aspect can efficiently be used with laminate floor panels, for example DPL or HPL, with preferably a wood-based substrate, for example MDF or HDF, as well as with plastic-based floor panels. Such plastic-based floor panels may be of various kinds. Non-limiting examples are: slightly foamed hard WPC panels, hard plastic panels and flexible plastic panels, such as LVT panels or similar panels made of a plastic other than vinyl.

It will be clear that the floor panels 1 preferably have a decorative upper side, for example in the form of a printed layer. In the case of a printed layer, this may be both a layer which has first been printed on a substrate which subsequently becomes part of the floor panel 1, and a printed layer which has been printed directly onto the floor panel 1, optionally using intermediate layers. Also, protective layers, such as wear layers may be provided.

According to an important preferred characteristic feature of the third aspect of the invention, the floor panel 1 is characterized in that that the first locking part 23 and/or the second locking part 24 are composed of one or more portions, for example 23 in FIG. 12 and for example 23A-23B-23C in FIGS. 16 to 18, as a result of which, in the coupled state, one or more overlap zones between the first locking part 23 and the second locking part 24 are formed; in that such an overlap zone is characterized by a maximum transverse overlap OT and a maximum longitudinal overlap OL, as is indicated in a number of the figures; and in that the maximum longitudinal overlap OL for at least one overlap zone at least satisfies one of following, and preferably several of the following criteria:

- the longitudinal overlap OL is at least 3 millimetres;
- the longitudinal overlap OL is at least 5 millimetres;
- the longitudinal overlap OL is at least 10 millimetres;
- the longitudinal overlap OL is at least 20 millimetres;
- the longitudinal overlap OL is at least 3 times the size of the transverse overlap OT;
- the longitudinal overlap OL is at least 10 times the size of the transverse overlap OT;
- the longitudinal overlap OL is at least 100 times the size of the transverse overlap OT;
- the longitudinal overlap (OL) is so large that, at the location of the centre of the longitudinal overlap (OL), the compressibility of the locking portions is essentially not affected by any absence of material at the longitudinal ends of the overlap zone.

The latter is particularly useful to ensure a strong locking.

If several overlap zones are present along the respective edges, then it is preferable for the majority thereof and preferably all overlap zones to satisfy one or more of the aforementioned criteria.

The Present Invention Also Relates to the Following List of Items:

1. —A panel, for example a floor panel or a wall panel, for forming a covering, wherein this panel (1) comprises a substrate and a top layer with a decorative surface, wherein the panel (1) comprises a first pair of opposite edges (2-3) and a second pair of opposite edges (4-5);

wherein the first pair of opposite edges (2-3) defines a first edge (2) and a second edge (3) of the panel (1), and the second pair of opposite edges (4-5) defines a third edge (4) and a fourth edge (5) of the panel (1);

wherein the first pair of opposite edges (2-3) comprises coupling parts (6-7) for coupling two such panels (1) to each other, these coupling parts (6-7) having the following characteristic features:

the coupling parts (6-7) optionally comprise a horizontally active locking system which, in a coupled state of two such panels (1), brings about a locking in the plane of the panels (1) and at right angles to the respective edges (2-3);

the coupling parts (6-7) comprise a vertically active locking system which, in a coupled state of two such panels (1), brings about a locking at right angles to the plane of the panels (1);

the coupling parts (6-7) are configured in such a way that two such panels (1) can be coupled to each other along these edges by means of a rotating movement (R);

wherein the second pair of opposite edges (4-5) comprises coupling parts (8-9) for coupling two such panels (1) to each other, these coupling parts (8-9) having the following characteristic features:

the coupling parts (8-9) comprise a horizontally active locking system with horizontally active locking parts which, in a coupled state of two such panels (1), brings about a locking in the plane of the panels (1) and at right angles to the respective edges (4-5);

the coupling parts (8-9) comprise a vertically active locking system with vertically active locking parts which, in a coupled state of two such panels (1), brings about a locking at right angles to the plane of the panels (1);

the coupling parts (8-9) are at least composed of an upwardly directed lower hook-shaped portion (10) which is situated on the third edge (4), and a downwardly directed upper hook-shaped portion (11) which is situated on the fourth edge (5), wherein the lower hook-shaped portion (10) consists of a lip (12) with an upwardly directed locking element (13) which, proximally therefrom, defines a female part in the form of an upwardly directed recess (14), whereas the upper hook-shaped portion (11) consists of a lip (15) with a downwardly directed locking element (16) which forms a male part and which, proximally therefrom, defines a downwardly directed recess (17), wherein the upwardly directed locking element (13) is designed to extend at least partly in the downwardly directed recess (17) and the downwardly directed locking element (16) is designed to extend at least partly in the upwardly directed recess (14);

the coupling parts (8-9) are configured in such a way that two such panels (1) can be coupled to each other along their respective edges (4-5) by means of a downward movement (M) of the one panel (1) with respect to the other panel (1);

the third edge (4) comprises an upright first closing surface which extends substantially in the longitudinal direction of the third edge (4), and the fourth edge (5) comprises an upright second closing surface which is complementary to the first closing surface and extends substantially in the longitudinal direction of the fourth edge (5), wherein, in the coupled state of two such panels (1), the first closing surface of the one panel (1) virtually bears against the second closing surface of the other panel (1), both together thus forming an upright closing surface(S), this closing surface extending between the decorative surfaces and the vertically and horizontally active locking parts;

wherein the second closing surface extends upright from a lower point, wherein a plane (A) which extends parallel to the decorative surface and through this lower point divides the downwardly directed locking element (16) into an upper portion (29) and a lower portion (30) which adjoins this upper portion (29), so that the lower portion (30) is delimited by a distal side and a proximal side, as well as by a bottom of the downwardly directed locking element (16), this lower portion (30) being designed to extend at least partly in the upwardly directed recess (14);

characterized in that the panel (1) has the following characteristic feature on the second pair of opposite edges (4-5):

viewed along the longitudinal direction of the fourth edge (5), the lower portion (30) of the downwardly directed locking element (16) comprises a first section (31) and a second section (32) wherein, viewed along a direction parallel to the decorative surface and at right angles to the fourth edge (5), the distal side of the first section (31) extends beyond the distal side of the second section (32) and beyond the second closing surface.

2. —The panel in accordance with item 1, wherein the coupling parts (6, 7) of the first pair of opposite edges (2-3) are at least formed by a tongue (25) which is situated on the first edge (2) and a groove (26) which is situated on the second edge (3), wherein the fourth edge (5), viewed along the longitudinal direction of the fourth edge (5) from the first edge (2) to the second edge (3), comprises a first half and a second half which adjoins the first half, wherein the first section (31) extends at least at the location of the first half and/or wherein the first section (31) extends between the first edge (2) and the second section (32).

3. —The panel in accordance with item 1 or 2, wherein, viewed along the longitudinal direction of the fourth edge (5), the length of the first section (31) is at least 20% of the total length of the fourth edge (5), preferably at least 30% and most preferably at least 40%.

4. —The panel in accordance with one of the preceding items, wherein, viewed along a direction parallel to the decorative surface and at right angles to the fourth edge (5), the distal side of the second section (32) extends beyond the second closing surface and/or at least partly extends at the location of the second closing surface.

5. —The panel in accordance with one of the preceding items, wherein the first closing surface and the second closing surface extend virtually at right angles to the decorative surface and the closing surface(S) extends virtually at right angles to the decorative surface.

6. —The panel in accordance with one of the preceding items, wherein, viewed along the longitudinal direction of the third edge (4), the design of the upwardly directed recess (14), and preferably of the lower hook-shaped portion (10), is virtually constant.

7. —The panel in accordance with one of the preceding items, wherein, viewed along the longitudinal direction of the fourth edge (5), the design of the upper portion (29) of the downwardly directed locking element (16) and/or the design of the downwardly directed recess (17) is virtually constant.

8. —The panel in accordance with one of the preceding items, wherein the lower portion (30) of the downwardly directed locking element (16) of the fourth edge (5) comprises a bottom portion at the bottom which is delimited at the bottom by the bottom of the downwardly directed locking element (16) and is designed to extend in the upwardly directed recess (14) of the third edge (4), with this bottom portion, at least at the location of the first section (31) and preferably along the entire longitudinal direction of the fourth edge (5), forming the most distal portion of the downwardly directed locking element (16), and at least a portion of the proximal side of the upwardly directed recess (14) of the third edge (4) extends proximally from and at a distance from the first closing surface, so that the bottom portion is accommodable in the upwardly directed recess (14).

9. —The panel in accordance with one of the preceding items, wherein the vertically active locking parts comprise at least a first locking part (23) which is present on the third edge (4) and extends substantially in the longitudinal direction of the third edge (4), and a second locking part (24) which is present on the fourth edge (5) and extends substantially in the longitudinal direction of the fourth edge (5), wherein, in the coupled state of two such panels (1), the first locking part (23) of the one panel (1) cooperates with the second locking part (24) of the other panel.

10. —The panel in accordance with item 8 and 9, wherein the first locking part (23) is situated on the proximal side of the female part and/or the second locking part (24) is situated on the distal side of the bottom portion.

11. —The panel in accordance with item 10, wherein the coupling parts (8-9) of the second pair of opposite edges (4-5) are formed as a single part with the material of the panel (1) itself, wherein the first locking part (23) is present on the proximal side of the female part in a solid manner and the second locking part (24) is present on the distal side of the bottom portion in a solid manner.

12. —The panel in accordance with item 8 and 11, wherein the second locking part (24) forms part of the bottom portion, and preferably the first and the second locking part (23, 24) form cooperating locking faces, these locking faces extending virtually parallel to the decorative surface.

13. —The panel in accordance with one of items 1 to 10, wherein the coupling parts (8-9) of the second pair of opposite edges (4-5) comprise at least a separate locking element (33) which, in a coupled state, cooperates with a locking groove (34) of the coupling parts (8-9) in order to partly or completely form the vertically active locking parts.

14. —The panel in accordance with item 8 or 10 and in accordance with item 13, wherein the locking element (33), at least in the coupled state, bears against the bottom portion.

15. —The panel in accordance with item 13 or 14, wherein one of the following characteristic features is present:

the third edge (4) comprises the separate locking element (33) and the locking groove (34) is present in the fourth edge (5), wherein the upper side of the bottom portion preferably delimits the underside of the locking groove (34) and wherein, in the coupled state, the separate locking element (33) is in contact with the upper side of the bottom portion, thus forming the first and the second locking part (23-24), respectively; or the fourth edge (5) comprises the separate locking element (33) and the locking groove (34) is present in the third edge (4).

16. —The panel in accordance with one of the preceding items, wherein, viewed along the longitudinal direction of the fourth edge (5), the design of the first section (31) and the second section (32) is constant, wherein preferably the first section (31) directly adjoins the second section (32); or there is a transition section (35) which gradually spans the distance between the first section (31) and the second section (32), viewed along a direction parallel to the decorative surface and at right angles to the fourth edge (5).

17. —The panel in accordance with one of the preceding items 1 to 15, wherein, viewed along the longitudinal direction of the fourth edge (5) towards the second section (32), the distance from the first section (31) to the second closing surface, viewed along a direction at right angles to the fourth edge (5) and parallel to the decorative surface, decreases, preferably decreases gradually, and preferably, viewed along the longitudinal direction of the fourth edge (5), the design of the second section (32) is constant.

18. —The panel in accordance with item 16 or 17, wherein the fourth edge (5), at the location of said lower portion (30), only comprises said first section (31), said second section (32) and the optional transition section (35).

19. —Th panel in accordance with one of the preceding items 1 to 15, wherein, viewed along the longitudinal direction of the fourth edge (5), the distance from the first section (31) to the second closing surface and/or the distance from the second section (32) to the second closing surface changes gradually.

20. —The panel in accordance with one of the preceding items, wherein the horizontal locking elements comprise at least a first horizontal locking part (36) which is present on the third edge (4) and extends substantially in the longitudinal direction of the third edge (4), and a second horizontal locking part (37) which is present on the fourth edge (5) and extends substantially in the longitudinal direction of the fourth edge (5), wherein the first horizontal locking part (36) extends on the proximal side of the upwardly directed locking element (13) and the second horizontal locking part (37) extends on the distal side of the downwardly directed recess (17), wherein, in the coupled state of two such panels (1), the first horizontal locking part (36) of the one panel (1) cooperates with the second horizontal locking part (37) of the other panel and is in contact under pretension.

21. —Method for forming a panel as in one or more of items 1 to 20, wherein the method comprises at least the following steps:

moving the panel (1) relative to cutting and/or milling tools (55-56-57); and treating the edges (2-3-4-5) of the moving panel (1) by means of the cutting and/or milling tools (55-56-57) to produce at least some of the coupling parts (6-7-8-9).

22. —Method in accordance with item 21, wherein, during the treatment of the edge which will form the fourth edge (5), at least one of the cutting and/or milling tools will be moved towards and/or away from the panel (1) in such a way that the depth of this cutting and/or milling tool (56) in the panel (1) changes in order to form said first and second section (31-32).

23. —Method in accordance with item 22, wherein, during the treatment of the edge which will form the fourth edge (5), said cutting and/or milling tool (56) is moved away from the panel (1), so that the second section (32) is formed first, followed by the first section (31).

24. —Method in accordance with one of the preceding items 21 to 23, wherein the coupling parts (6-7) of the first pair of opposite edges (2-3) are formed by means of stationary cutting or milling tools.

25. —Method in accordance with one of the preceding items 21 to 24, wherein the cutting or milling tools are rotating cutting or milling tools.

26. —A panel, for example a floor panel or a wall panel, for forming a covering, and optionally in accordance with one or more of items 1 to 20, wherein this panel (1) comprises a substrate and a top layer with a decorative surface, wherein the panel (1) comprises a first pair of opposite edges (2-3) and a second pair of opposite edges (4-5);

wherein the first pair of opposite edges (2-3) defines a first edge (2) and a second edge (3) of the panel (1), and the second pair of opposite edges (4-5) defines a third edge (4) and a fourth edge (5) of the panel (1);

wherein the first pair of opposite edges (2-3) comprises coupling parts (6-7) for coupling two such panels (1) to each other, wherein these coupling parts (6-7) have the following characteristic features:

the coupling parts (6-7) optionally comprise a horizontally active locking system which, in a coupled state of two such panels (1), brings about a locking in the plane of the panels (1) and at right angles to the respective edges (2-3);

the coupling parts (6-7) comprise a vertically active locking system which, in a coupled state of two such panels (1), brings about a locking at right angles to the plane of the panels (1);

the coupling parts (6-7) are configured in such a way that two such panels (1) can be coupled to each other along these edges by means of a rotating movement (R);

wherein the second pair of opposite edges (4-5) comprises coupling parts (8-9) for coupling two such panels (1) to each other, wherein these coupling parts (8-9) have the following characteristic features:

the coupling parts (8-9) comprise a horizontally active locking system with horizontally active locking parts which, in a coupled state of two such panels (1), brings about a locking in the plane of the panels (1) and at right angles to the respective edges (4-5);

the coupling parts (8-9) comprise a vertically active locking system with vertically active locking parts which, in a coupled state of two such panels (1), brings about a locking at right angles to the plane of the panels (1);

the coupling parts (8-9) are formed as a single part with the material of the panel (1) itself;

the coupling parts (8, 9) are at least formed by an upwardly directed lower hook-shaped portion (10) which is situated on the third edge (4), and a downwardly directed upper hook-shaped portion (11) which is situated on the fourth edge (5), wherein the lower hook-shaped portion (10) consists of a lip (12) with an upwardly directed locking element (13) which, proximally therefrom, defines a female part in the form of an upwardly directed recess (14), whereas the upper hook-shaped portion (11) consists of a lip (15) with a downwardly directed locking element (16) which forms a male part and which, proximally therefrom, defines a downwardly directed recess (17), wherein the upwardly directed locking element (13) is designed to extend at least partly in the downwardly directed recess (17) and the downwardly directed locking element (16) is designed to extend at least partly in the upwardly directed recess (14);

the coupling parts (8-9) are configured in such a way that two such panels (1) can be coupled to each other along their respective edges (4-5) by means of a downward movement (M) of the one panel (1) with respect to the other panel (1);

the vertically active locking parts are at least formed by a first locking part (23) which is present on the aforementioned third edge (4) and extends substantially in the longitudinal direction of the third edge (4), and a second locking part (24) which is present on the aforementioned fourth edge (5) and extends substantially in the longitudinal direction of the fourth edge (5), wherein, in the coupled state of two such panels (1), the first locking part (23) of the one panel (1) cooperates with the second locking part (24) of the other; and the first locking part (23) and the second locking part (24) are situated at levels which are higher than a bottom of the upwardly directed recess (14);

characterized in that the panel (1) has the following combination of characteristic features on the second pair of opposite edges (4-5):

the first locking part (23) is situated on the proximal side of the female part and is in this case present on this proximal side in a solid manner;

the second locking part (24) is situated on the distal side of the male part and is in this case present on this distal side in a solid manner; and at least one of the locking parts (23-24) of the pair of locking parts (23-24) which is formed by the first locking part (23) and the second locking part (24) is of a variable design in the longitudinal direction of the respective edge (4-5), wherein preferably said variable design provides for the cross section of at least one of the locking parts (23-24) of the aforementioned pair of locking parts (23-24) to vary and the variable design is configured in such a way that, in a coupled state, the transverse overlap (OT) between the first locking part (23) and the second locking part (24) varies in the longitudinal direction.

27. —The panel in accordance with item 26, wherein the first locking part (23) and the second locking part (24) are provided with contact surfaces and the aforementioned variable design provides for the contact surface of the first locking part (23) and/or the contact surface of the second locking part (24) to change in angular position or shape.

28. —The panel in accordance with item 27, wherein the contact surfaces are configured in such a way that at least the angle of the tangent line which is defined by the contact surfaces in the coupled position varies in the longitudinal direction.

29. —The panel in accordance with item 27 or 28, wherein the contact surfaces are configured in such a way that at least the position where the contact surfaces come into contact with each other, viewed in the height and/or transverse direction, varies depending on the longitudinal direction.

The present invention is by no means limited to the embodiments described as examples and illustrated in the figures, but such a floor panel, and in the particular the coupling parts, can be brought about in different shapes and dimensions without departing from the scope of the invention.

The invention claimed is:

1. A panel, for example a floor panel or a wall panel, for forming a covering, wherein this panel comprises a substrate and a top layer with a decorative surface, wherein the panel comprises a first pair of opposite edges and a second pair of opposite edges;

wherein the first pair of opposite edges defines a first edge and a second edge of the panel, and the second pair of opposite edges defines a third edge and a fourth edge of the panel;

wherein the first pair of opposite edges comprises coupling parts for coupling two such panels to each other, these coupling parts having the following characteristic features:

the coupling parts comprise a vertically active locking system which, in a coupled state of two such panels, brings about a locking at right angles to the plane of the panels;

the coupling parts are configured in such a way that two such panels can be coupled to each other along these edges by means of a rotating movement;

wherein the second pair of opposite edges comprises coupling parts for coupling two such panels to each other, these coupling parts having the following characteristic features:

the coupling parts comprise a horizontally active locking system with horizontally active locking parts which, in a coupled state of two such panels, brings about a locking in the plane of the panels and at right angles to the respective edges;

the coupling parts comprise a vertically active locking system with vertically active locking parts which, in a coupled state of two such panels, brings about a locking at right angles to the plane of the panels;

the coupling parts are at least composed of an upwardly directed lower hook-shaped portion which is situated on the third edge, and a downwardly directed upper hook-shaped portion which is situated on the fourth edge, wherein the lower hook-shaped portion consists of a lip with an upwardly directed locking element which, proximally therefrom, defines a female part in the form of an upwardly directed recess, whereas the upper hook-shaped portion consists of a lip with a downwardly directed locking element which forms a male part and which, proximally therefrom, defines a downwardly directed recess, wherein the upwardly directed locking element is designed to extend at least partly in the downwardly directed recess and the downwardly directed locking element is designed to extend at least partly in the upwardly directed recess;

the coupling parts are configured in such a way that two such panels can be coupled to each other along their respective edges by means of a downward movement of the one panel with respect to the other panel;

the third edge comprises an upright first closing surface which extends substantially in the longitudinal direction of the third edge, and the fourth edge comprises an upright second closing surface which is complementary to the first closing surface and extends substantially in the longitudinal direction of the fourth edge, wherein, in the coupled state of two such panels, the first closing surface of the one panel virtually bears against the second closing surface of the other panel, both together thus forming an upright closing surface, this closing surface extending between the decorative surfaces and the vertically and horizontally active locking parts;

wherein the second closing surface extends upright from a lower point, wherein a plane which extends parallel to the decorative surface and through this lower point divides the downwardly directed locking element into an upper portion and a lower portion which adjoins this upper portion, so that the lower portion is delimited by a distal side and a proximal side, as well as by a bottom of the downwardly directed locking element, this lower portion being designed to extend at least partly in the upwardly directed recess;

characterized in that the panel has the following characteristic feature on the second pair of opposite edges:

viewed along the longitudinal direction of the fourth edge, the lower portion of the downwardly directed locking element comprises a first section and a second section wherein, viewed along a direction parallel to the decorative surface and at right angles to the fourth edge, the distal side of the first section extends beyond the distal side of the second section and beyond the second closing surface.

2. The panel as in claim 1, wherein the coupling parts of the first pair of opposite edges are at least formed by a tongue which is situated on the first edge and a groove which is situated on the second edge, wherein the fourth edge, viewed along the longitudinal direction of the fourth edge from the first edge to the second edge, comprises a first half and a second half which adjoins the first half, wherein the first section extends at least at the location of the first half and/or wherein the first section extends between the first edge and the second section.

3. The panel as in claim 1, wherein, viewed along the longitudinal direction of the fourth edge, the length of the first section is at least 20% of the total length of the fourth edge.

4. The panel as in claim 1, wherein, viewed along a direction parallel to the decorative surface and at right angles to the fourth edge, the distal side of the second section extends beyond the second closing surface and/or at least partly extends at the location of the second closing surface.

5. The panel as in claim 1, wherein the first closing surface and the second closing surface extend virtually at right angles to the decorative surface and the closing surface extends virtually at right angles to the decorative surface.

6. The panel as in claim 1, wherein, viewed along the longitudinal direction of the third edge, the design of the upwardly directed recess, and of the lower hook-shaped portion, is virtually constant.

7. The panel as in claim 1, wherein, viewed along the longitudinal direction of the fourth edge, the design of the upper portion of the downwardly directed locking element and/or the design of the downwardly directed recess is virtually constant.

8. The panel as in claim 1, wherein the lower portion of the downwardly directed locking element of the fourth edge comprises a bottom portion at the bottom which is delimited at the bottom by the bottom of the downwardly directed locking element and is designed to extend in the upwardly directed recess of the third edge, with this bottom portion, at least at the location of the first section and along the entire longitudinal direction of the fourth edge, forming the most distal portion of the downwardly directed locking element, and at least a portion of the proximal side of the upwardly directed recess of the third edge extends proximally from and at a distance from the first closing surface, so that the bottom portion is accommodable in the upwardly directed recess.

9. The panel as in claim 8, wherein the first locking part is situated on the proximal side of the female part and/or the second locking part is situated on the distal side of the bottom portion.

10. The panel as in claim 9, wherein the coupling parts of the second pair of opposite edges are formed as a single part with the material of the panel itself, wherein the first locking part is present on the proximal side of the female part in a solid manner and the second locking part is present on the distal side of the bottom portion in a solid manner.

11. The panel as in claim 1, wherein the coupling parts of the second pair of opposite edges comprise at least a separate locking element which, in a coupled state, cooperates with a locking groove of the coupling parts in order to partly or completely form the vertically active locking parts.

12. The panel as in claim 1, wherein the vertically active locking parts comprise at least a first locking part which is present on the third edge and extends substantially in the longitudinal direction of the third edge, and a second locking part which is present on the fourth edge and extends substantially in the longitudinal direction of the fourth edge, wherein, in the coupled state of two such panels, the first locking part of the one panel cooperates with the second locking part of the other panel.

13. The panel as in claim 11, wherein one of the following characteristic features is present:

the third edge comprises the separate locking element and the locking groove is present in the fourth edge, wherein the upper side of the bottom portion delimits the underside of the locking groove and wherein, in the coupled state, the separate locking element is in contact with the upper side of the bottom portion, thus forming the first and the second locking part, respectively; or the fourth edge comprises the separate locking element and the locking groove is present in the third edge.

14. The panel as in claim 1, wherein, viewed along the longitudinal direction of the fourth edge, the design of the first section and the second section is constant, wherein the first section directly adjoins the second section; or there is a transition section which gradually spans the distance between the first section and the second section, viewed along a direction parallel to the decorative surface and at right angles to the fourth edge.

15. The panel as in claim 14, wherein the fourth edge, at the location of said lower portion, only comprises said first section, said second section and the optional transition section.

16. The panel as in claim 1, wherein, viewed along the longitudinal direction of the fourth edge towards the second section, the distance from the first section to the second closing surface, viewed along a direction at right angles to the fourth edge and parallel to the decorative surface, decreases, decreases gradually, and, viewed along the longitudinal direction of the fourth edge, the design of the second section is constant.

17. The panel as in claim 1, wherein, viewed along the longitudinal direction of the fourth edge, the distance from the first section to the second closing surface and/or the distance from the second section to the second closing surface changes gradually.

18. The panel as in claim 1, wherein the horizontal locking elements comprise at least a first horizontal locking part which is present on the third edge and extends substantially in the longitudinal direction of the third edge, and a second horizontal locking part which is present on the fourth edge and extends substantially in the longitudinal direction of the fourth edge, wherein the first horizontal locking part extends on the proximal side of the upwardly directed locking element and the second horizontal locking part extends on the distal side of the downwardly directed recess, wherein, in the coupled state of two such panels, the first horizontal locking part of the one panel cooperates with the second horizontal locking part of the other panel and is in contact under pretension.

19. A method for forming a panel as in claim 1, wherein the method comprises at least the following steps:

moving the panel relative to cutting and/or milling tools; and treating the edges of the moving panel by means of the cutting and/or milling tools to produce at least some of the coupling parts.

20. The method as in claim 19, wherein, during the treatment of the edge which will form the fourth edge, at least one of the cutting and/or milling tools will be moved towards and/or away from the panel in such a way that the depth of this cutting and/or milling tool in the panel changes in order to form said first and second section.

* * * * *